US009281171B2

(12) United States Patent
Bateman et al.

(10) Patent No.: US 9,281,171 B2
(45) Date of Patent: Mar. 8, 2016

(54) MASS SPECTROMETER

(75) Inventors: Robert Harold Bateman, Cheshire, MA (US); Kevin Giles, Cheshire (GB); Jeffery Mark Brown, Cheshire (GB); Steven Derek Pringle, Darwen (GB); Jason Lee Wildgoose, Stockport (GB)

(73) Assignee: Micromass UK Limited, Wilmslow (GB)

( * ) Notice: Subject to any disclaimer, the term of this patent is extended or adjusted under 35 U.S.C. 154(b) by 2190 days.

(21) Appl. No.: 11/721,260

(22) PCT Filed: Dec. 8, 2005

(86) PCT No.: PCT/GB2005/004724

§ 371 (c)(1), (2), (4) Date: Dec. 3, 2009

(87) PCT Pub. No.: WO2006/061625

PCT Pub. Date: Jun. 15, 2006

(65) Prior Publication Data

US 2010/0065737 A1 Mar. 18, 2010

Related U.S. Application Data

(60) Provisional application No. 60/637,705, filed on Dec. 21, 2004.

(30) Foreign Application Priority Data

Dec. 8, 2004 (GB) ..... 0426900.7

(51) Int. Cl.

| | |
|---|---|
| ***H01J 49/40*** | (2006.01) |
| ***H01J 49/06*** | (2006.01) |
| ***H01J 49/00*** | (2006.01) |

(52) U.S. Cl.
CPC ..... *H01J 49/062* (2013.01); *H01J 49/004* (2013.01)

(58) Field of Classification Search
USPC ..... 250/281, 282, 283
See application file for complete search history.

(56) References Cited

U.S. PATENT DOCUMENTS

| | | | | |
|---|---|---|---|---|
| 6,483,109 | B1 | 11/2002 | Reinhold et al. | |
| 6,770,871 | B1 | 8/2004 | Wang et al. | |
| 6,987,264 | B1 * | 1/2006 | Whitehouse | H01J 49/004 250/292 |
| 7,829,841 | B2 * | 11/2010 | Bateman et al. | 250/281 |
| 2002/0008198 | A1 * | 1/2002 | Kasten et al. | 250/292 |
| 2002/0148959 | A1 | 10/2002 | Weiss et al. | |

(Continued)

FOREIGN PATENT DOCUMENTS

| | | |
|---|---|---|
| GB | 2391697 | 2/2004 |
| GB | 2391698 | 2/2004 |

(Continued)

*Primary Examiner* — Nicole Ippolito
(74) *Attorney, Agent, or Firm* — Diederiks & Whitelaw, PLC

(57) ABSTRACT

A mass spectrometer is disclosed comprising a mass selective ion trap or mass analyzer arranged upstream of an ion guide. Ions are scanned out of the mass selective ion trap or mass analyzer and are received in one or more axial potential wells created or formed within the ion guide. One or more transient DC voltages or potentials are preferably applied to the ion guide in order to create a plurality of axial potential wells which are translated along the length of the ion guide. Ions are released in packets from the exit of the ion guide and are orthogonally acceleration into a drift or flight region of an orthogonal acceleration Time of Flight mass analyzer with a relatively high duty cycle.

26 Claims, 6 Drawing Sheets

(56) References Cited

U.S. PATENT DOCUMENTS

| | | | | |
|---|---|---|---|---|
| 2003/0001088 | A1* | 1/2003 | Bateman et al. | 250/287 |
| 2003/0213900 | A1* | 11/2003 | Hoyes | 250/282 |
| 2004/0026613 | A1 | 2/2004 | Bateman et al. | |
| 2004/0026614 | A1 | 2/2004 | Bateman et al. | |
| 2004/0079880 | A1 | 4/2004 | Bateman et al. | |
| 2004/0108450 | A1 | 6/2004 | Makarov et al. | |
| 2004/0188603 | A1 | 9/2004 | Bateman et al. | |
| 2004/0211897 | A1* | 10/2004 | Kim et al. | 250/288 |
| 2005/0092912 | A1* | 5/2005 | Krutchinsky et al. | 250/286 |

FOREIGN PATENT DOCUMENTS

| | | |
|---|---|---|
| GB | 2392006 | 2/2004 |
| GB | 2394356 | 4/2004 |
| GB | 2397433 | 7/2004 |
| GB | 2400488 | 10/2004 |
| GB | 2421843 | 7/2006 |

* cited by examiner

MASS SPECTROMETER

BACKGROUND OF THE INVENTION

The present invention relates to a mass spectrometer and method of mass spectrometry.

Orthogonal acceleration Time of Flight mass analysers are known wherein ions having approximately the same energy are passed through a space in which an orthogonal acceleration field is periodically applied. The length of the orthogonal acceleration region, the energy of the ions and the frequency of the application of the orthogonal acceleration field determine the sampling duty cycle for sampling ions for analysis in the Time of Flight mass analyser. Ions having approximately the same energy but having different mass to charge ratios will have different velocities and hence will have different sampling duty cycles.

The maximum ion sampling duty cycle for an orthogonal acceleration Time of Flight mass analyser of conventional design when used with a continuous ion beam is typically about 20-25%. This is only achieved for ions having a maximum mass to charge ratio and the ion sampling duty cycle is less for ions having lower mass to charge ratios. If ions having the maximum mass to charge ratio have an mass to charge ratio of mo and the sampling duty cycle for these ions is Dco, then the sampling duty cycle Dc for ions having a mass to charge ratio m is given by:

$$Dc = Dco \cdot \sqrt{\frac{m}{mo}} \quad (1)$$

It can be shown that the average sampling duty cycle is equal to ⅔ of the maximum sampling duty cycle Dco. Hence, if the maximum sampling duty cycle is 22.5% then the average sampling duty cycle is 15%.

If ions are stored in an ion trap upstream of an orthogonal acceleration Time of Flight mass analyser and are then released into the mass analyser as a series of packets, rather than allowed to flow continuously, then the energisation of the pusher electrode can be synchronised with respect to the release of each packet of ions. However, ions having the same energy but different mass to charge ratios will enter the mass analyser with different velocities. Hence, ions with different mass to charge ratios will arrive at the orthogonal acceleration region adjacent the pusher electrode at different times. The time delay between the release of ions and the subsequent energisation of the pusher electrode determines the mass to charge ratios of the ions that are orthogonally accelerated and which are therefore transmitted into the orthogonal acceleration drift region of the mass analyser. For these ions the duty cycle can now be increased to substantially 100%. However, ions having other mass to charge ratios will not be arranged so as to be adjacent the pusher electrode at the time when the pusher electrode is energised and hence these ions will have lower sampling efficiencies. Ions with very different mass to charge ratios will have a sampling efficiency of zero.

An alternative approach is to trap and store ions in a mass selective ion trap such as a 3D quadrupole or Paul ion trap. Such ion traps may be operated so as to permit only ions having a selected mass to charge ratio or a range of mass to charge ratios to be ejected from the mass selective ion trap. Accordingly, ions having a relatively narrow range of mass to charge ratios can be arranged to be ejected from the ion trap. The time delay between the ejection of a packet of ions from the ion trap to the energisation of the pusher electrode can be set to be that required for the range of mass to charge ratios of the ions released from the ion trap. Ions having other mass to charge ratios are retained within the ion trap and can be released in a subsequent packet of ions released from the ion trap. For each cycle, ions having a different range of mass to charge ratios can be released from the ion trap and the delay time can be set as appropriate for that range of mass to charge ratios. Eventually all the ions within the ion trap may be released and mass analysed.

Quadrupole ion traps may be scanned to mass selectively eject ions in two distinct ways. Firstly, either the RF voltage and/or the DC voltage may be scanned to sequentially move ions from within regimes of stable ion motion to regimes of unstable ion motion. This is known as mass-selective instability. Secondly, an ancillary AC voltage (or tickle voltage) may be applied to the end caps of the quadrupole ion trap to resonantly excite and eventually eject ions having a specific mass to charge ratio value. This is known as resonance ejection. The RF voltage or the frequency of the AC tickle voltage may be scanned to sequentially eject ions having different mass to charge ratios.

It may be desired to scan down in mass to charge ratio very quickly. To release ions in the axial direction in reverse order using mass-selective instability it is necessary to scan such that ions sequentially cross the $\beta z=0$ boundary of the stability regime. This can be achieved by progressively applying a reverse DC voltage between the centre ring and the end caps of the ion trap or by scanning both the DC voltage and RF voltage.

Another method of ejecting ions in reverse order of mass to charge ratio is to apply a small DC dipole between the end caps of the ion trap. Ions with the smallest $\beta z$ values are displaced towards the negative cap. As this voltage is increased first ions having relatively high mass to charge ratios and then subsequently ions having relatively low mass to charge ratios are ejected. This has the advantage of ejecting ions in one axial direction only. The method of resonance ejection may also be used to eject ions in reverse order of mass to charge ratio.

The known arrangements described above suffer from the fact that ions will be resonantly ejected from the quadrupole ion trap with relatively high energies and with a relatively high spread of energies. The energies of the ions and the energy spread may be many tens of electron volts or even hundreds of electron volts depending upon the precise method of scanning. Furthermore, the ion energies and energy spreads will vary with mass to charge ratio depending on the method of scanning.

It will be appreciated that since it is desirable that all the ions arrive at the orthogonal acceleration region with approximately the same energy then the known approach may be problematic.

It is also desirable for an ion beam to be tightly collimated as it passes through the orthogonal acceleration region of a orthogonal acceleration Time of Flight analyser in order to achieve good mass resolution. Since ions ejected from a quadrupole ion trap will have relatively large energies and relatively large energy spreads then conventionally it is usually necessary to reject a considerable proportion of these ions in order to obtain a narrowly collimated ion beam. This in turn reduces sensitivity.

It is therefore desired to provide an improved mass spectrometer.

SUMMARY OF THE INVENTION

According to an aspect of the present invention there is provided a mass spectrometer comprising:

a mass selective ion trap or mass analyser;

a first ion guide arranged downstream of the mass selective ion trap or mass analyser, the first ion guide being arranged to receive ions from the mass selective ion trap or mass analyser, and wherein the first ion guide comprises a plurality of electrodes;

a first voltage means arranged and adapted to apply one or more voltages or one or more voltage waveforms to the plurality of electrodes so that in a first mode of operation ions received from the mass selective ion trap or mass analyser are retained and/or confined and/or transported and/or translated in separate regions or portions of the first ion guide; and a mass analyser arranged downstream of the first ion guide.

According to an embodiment the mass selective ion trap or mass analyser may comprise a 3D quadrupole or Paul ion trap or mass analyser. The 3D or Paul ion trap or mass analyser preferably comprises a ring electrode and two hyperbolic end cap electrodes.

According to another embodiment the mass selective ion trap or mass analyser may comprise a 2D or linear quadrupole ion trap or mass analyser. The 2D or linear quadrupole ion trap or mass analyser preferably comprises a quadrupole rod set ion trap or mass analyser.

According to another embodiment the mass selective ion trap or mass analyser preferably comprises a cylindrical ion trap or mass analyser. The cylindrical ion trap or mass analyser preferably comprises a cylindrical electrode and one or more planar end cap electrodes.

According to another embodiment the mass selective ion trap or mass analyser preferably comprises a cubic ion trap or mass analyser. The cubic ion trap or mass analyser preferably comprises six planar electrodes. The ion trap or mass analyser preferably further comprises a three-phase AC or RF voltage supply wherein one or more pairs of opposed planar electrodes are connected or supplied with one of three phases of the three-phase AC or RF voltage supply.

According to another embodiment the mass selective ion trap or mass analyser comprises an AC or RF voltage means for confining ions radially within the mass selective ion trap or mass analyser and a DC voltage means for confining ions axially within the mass selective ion trap or mass analyser.

According to another embodiment the mass selective ion trap or mass analyser comprises a Penning ion trap. The Penning ion trap preferably comprises magnetic field means for confining ions radially as ions follow a circular trajectory. The Penning ion trap preferably further comprises DC electric field means and/or AC or RF electric field means for confining ions axially within the Penning ion trap.

According to another embodiment the mass selective ion trap comprises an electrostatic or orbitrap mass analyser. The electrostatic or orbitrap mass analyser preferably further comprises DC electric field means for confining ions within the electrostatic or orbitrap mass analyser. The electrostatic or orbitrap mass analyser preferably further comprises means for maintaining the electrostatic or orbitrap mass analyser at a pressure $<10^{-9}$ mbar.

According to an embodiment there is provided AC or RF voltage means arranged and adapted to apply an AC or RF voltage to the mass selective ion trap or mass analyser. The AC or RF voltage means is preferably arranged and adapted to supply an AC or RF voltage having an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak. The AC or RF voltage means is preferably arranged and adapted to supply an AC or RF voltage having a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

According to an embodiment there is provided means arranged and adapted to maintain in a mode of operation the mass selective ion trap or mass analyser at a pressure selected from the group consisting of: (i) $<1.0\times10^{-1}$ mbar; (ii) $<1.0\times10^{-2}$ mbar; (iii) $<1.0\times10^{-3}$ mbar; (iv) $<1.0\times10^{-4}$ mbar; (v) $<1.0\times10^{-5}$ mbar; (vi) $<1.0\times10^{-6}$ mbar; (vii) $<1.0\times10^{-7}$ mbar; (viii) $<1.0\times10^{-8}$ mbar; (ix) $<1.0\times10^{-9}$ mbar; and (x) $<1.0\times10^{-10}$ mbar.

According to an embodiment there is provided means arranged and adapted to maintain in a mode of operation the mass selective ion trap or mass analyser at a pressure selected from the group consisting of: (i) $>1.0\times10^{-3}$ mbar; (ii) $>1.0\times10^{-2}$ mbar; (iii) $>1.0\times10^{-1}$ mbar; (iv) >1 mbar; (v) >10 mbar; (vi) >100 mbar; (vii) $>5.0\times10^{-3}$ mbar; (viii) $>5.0\times10^{-2}$ mbar; (ix) $10^{-3}$-$10^{-2}$ mbar; and (x) $10^{-4}$-$10^{-1}$ mbar.

In a mode of operation ions are preferably trapped but are not substantially fragmented within the mass selective ion trap or mass analyser.

According to another embodiment there may be provided means arranged and adapted to substantially fragment ions within the mass selective ion trap or mass analyser.

The mass spectrometer preferably further comprises ejection means arranged and adapted to resonantly and/or mass selectively eject ions from the mass selective ion trap or mass analyser.

The mass spectrometer may comprise ejection means arranged and adapted to non-resonantly and/or mass selectively eject ions from the mass selective ion trap or mass analyser.

The mass spectrometer preferably further comprises ejection means arranged and adapted to eject or emit ions axially and/or radially from the mass selective ion trap or mass analyser.

The ejection means may be arranged and adapted to adjust the frequency and/or amplitude of an AC or RF voltage applied to the mass selective ion trap or mass analyser in order to eject ions from the mass selective ion trap or mass analyser by mass selective instability.

The ejection means may further comprise means for superimposing an AC or RF supplementary waveform or voltage to the plurality of electrodes in order to eject ions from the mass selective ion trap or mass analyser by resonance ejection.

The ejection means may further comprise means for applying a DC bias voltage to the mass selective ion trap or mass analyser in order to eject ions from the mass selective ion trap or mass analyser.

The mass spectrometer preferably further comprises means for pulsing ions into the mass selective ion trap or mass analyser once every 0-5 ms, 5-10 ms, 10-15 ms, 15-20 ms, 20-25 ms, 25-30 ms, 30-35 ms, 35-40 ms, 40-45 ms, 45-50 ms or >50 ms.

According to an embodiment of the present invention the first ion guide preferably comprises:

(i) a multipole rod set or a segmented multipole rod set;

(ii) an ion tunnel or ion funnel; or (iii) a stack or array of planar, plate or mesh electrodes.

According to an embodiment the mass spectrometer preferably further comprises a second ion guide arranged upstream of the mass selective ion trap or mass analyser.

The second ion guide preferably comprises:

(i) a multipole rod set or a segmented multipole rod set;

(ii) an ion tunnel or ion funnel; or (iii) a stack or array of planar, plate or mesh electrodes.

The multipole rod set or the segmented multipole rod set of the first and/or second ion guide may comprise a quadrupole rod set, a hexapole rod set, an octapole rod set or a rod set comprising more than eight rods.

The ion tunnel or ion funnel of the first and/or second ion guide may comprise a plurality of electrodes or at least 2, 5, 10, 20, 30, 40, 50, 60, 70, 80, 90 or 100 electrodes having apertures through which ions are transmitted in use, wherein at least 5%, 10%, 15%, 20%, 25%, 30%, 35%, 40%, 45%, 50%, 55%, 60%, 65%, 70%, 75%, 80%, 85%, 90%, 95% or 100% of the electrodes have apertures which are of substantially the same size or area or which have apertures which become progressively larger and/or smaller in size or in area. Preferably, at least 5%, 10%, 15%, 20%, 25%, 30%, 35%, 40%, 45%, 50%, 55%, 60%, 65%, 70%, 75%, 80%, 85%, 90%, 95% or 100% of the electrodes have internal diameters or dimensions selected from the group consisting of: (i) ≤1.0 mm; (ii) ≤2.0 mm; (iii) ≤3.0 mm; (iv) ≤4.0 mm; (v) ≤5.0 mm; (vi) ≤6.0 mm; (vii) ≤7.0 mm; (viii) ≤8.0 mm; (ix) ≤9.0 mm; (x) ≤10.0 mm; and (xi) >10.0 mm.

According to an embodiment the stack or array of planar, plate or mesh electrodes of the first and/or second ion guides may comprise a plurality or at least 2, 3, 4, 5, 6, 7, 8, 9, 10, 11, 12, 13, 14, 15, 16, 17, 18, 19 or 20 planar, plate or mesh electrodes arranged generally in the plane in which ions travel in use, wherein at least 5%, 10%, 15%, 20%, 25%, 30%, 35%, 40%, 45%, 50%, 55%, 60%, 65%, 70%, 75%, 80%, 85%, 90%, 95% or 100% of the planar, plate or mesh electrodes are arranged generally in the plane in which ions travel in use.

The mass spectrometer preferably further comprises AC or RF voltage means for supplying the plurality of planar, plate or mesh electrodes of the first and/or second ion guides with an AC or RF voltage and wherein adjacent planar, plate or mesh electrodes are supplied with opposite phases of the AC or RF voltage.

The first ion guide and/or the second ion guide preferably comprise a plurality of axial segments or at least 5, 10, 15, 20, 25, 30, 35, 40, 45, 50, 55, 60, 65, 70, 75, 80, 85, 90, 95 or 100 axial segments.

The mass spectrometer preferably further comprises transient DC voltage means arranged and adapted to apply one or more transient DC voltages or potentials or one or more transient DC voltage or potential waveforms to electrodes forming the first ion guide and/or the second ion guide in order to urge at least some ions along at least 5%, 10%, 15%, 20%, 25%, 30%, 35%, 40%, 45%, 50%, 55%, 60%, 65%, 70%, 75%, 80%, 85%, 90%, 95% or 100% of the axial length of the first ion guide and/or the second ion guide.

The mass spectrometer may comprise AC or RF voltage means arranged and adapted to apply two or more phase-shifted AC or RF voltages to electrodes forming the first ion guide and/or the second ion guide in order to urge at least some ions along at least 5%, 10%, 15%, 20%, 25%, 30%, 35%, 40%, 45%, 50%, 55%, 60%, 65%, 70%, 75%, 80%, 85%, 90%, 95% or 100% of the axial length of the first ion guide and/or the second ion guide.

According to an embodiment the first ion guide and/or the second ion guide may have an axial length selected from the group consisting of: (i) <20 mm; (ii) 20-40 mm; (iii) 40-60 mm; (iv) 60-80 mm; (v) 80-100 mm; (vi) 100-120 mm; (vii) 120-140 mm; (viii) 140-160 mm; (ix) 160-180 mm; (x) 180-200 mm; (xi) 200-220 mm; (xii) 220-240 mm; (xiii) 240-260 mm; (xiv) 260-280 mm; (xv) 280-300 mm; and (xvi) >300 mm.

The first ion guide and/or the second ion guide preferably further comprises AC or RF voltage means arranged and adapted to apply an AC or RF voltage to at least 5%, 10%, 15%, 20%, 25%, 30%, 35%, 40%, 45%, 50%, 55%, 60%, 65%, 70%, 75%, 80%, 85%, 90%, 95% or 100% of the plurality of electrodes of the first ion guide and/or the second ion guide in order to confine ions radially within the first ion guide and/or the second ion guide. The AC or RF voltage means is preferably arranged and adapted to supply an AC or RF voltage to the plurality of electrodes of the first ion guide and/or the second ion guide having an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak. The AC or RF voltage means is preferably arranged and adapted to supply an AC or RF voltage to the plurality of electrodes of the first ion guide and/or the second ion guide having a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

According to an embodiment singly charged ions having a mass to charge ratio in the range of 1-100, 100-200, 200-300, 300-400, 400-500, 500-600, 600-700, 700-800, 800-900 or 900-1000 preferably have a drift or transit time through the first ion guide and/or the second ion guide in the range: (i) 0-10 μs; (ii) 10-20 μs; (iii) 20-30 μs; (iv) 30-40 μs; (v) 40-50 μs; (vi) 50-60 μs; (vii) 60-70 μs; (viii) 70-80 μs; (ix) 80-90 μs; (x) 90-100 μs; (xi) 100-110 μs; (xii) 110-120 μs; (xiii) 120-130 μs; (xiv) 130-140 μs; (xv) 140-150 μs; (xvi) 150-160 μs; (xvii) 160-170 μs; (xviii) 170-180 μs; (xix) 180-190 μs; (xx) 190-200 μs; (xxi) 200-210 μs; (xxii) 210-220 μs; (xxiii) 220-230 μs; (xxiv) 230-240 μs; (xxv) 240-250 μs; (xxvi) 250-260 μs; (xxvii) 260-270 μs; (xxviii) 270-280 μs; (xxix) 280-290 μs; (xxx) 290-300 μs; and (xxxi) >300 μs.

According to an embodiment the mass spectrometer further comprises means arranged and adapted to maintain at least a portion of the first ion guide at a pressure selected from the group consisting of: (i) >0.0001 mbar; (ii) >0.001 mbar; (iii) >0.01 mbar; (iv) >0.1 mbar; (v) >1 mbar; (vi) >10 mbar; (vii) 0.0001-0.1 mbar; and (viii) 0.001-0.01 mbar.

The mass spectrometer preferably further comprises acceleration means arranged and adapted to accelerate ions emerging from the mass selective ion trap or mass analyser into the first ion guide and wherein in a second mode of operation at least 5%, 10%, 15%, 20%, 25%, 30%, 35%, 40%, 45%, 50%, 55%, 60%, 65%, 70%, 75%, 80%, 85%, 90%, 95% or 100% of the ions are caused to fragment upon entering the first ion guide. The acceleration means is preferably arranged and adapted to progressively vary or increase the kinetic energy of ions emerging from the mass selective ion trap or mass analyser as they are transmitted to the first ion guide.

The acceleration means preferably comprises a region across which a potential difference is maintained and wherein the potential difference is progressively varied or increased with time.

According to an embodiment the mass spectrometer preferably further comprises a control system arranged and adapted to switch or repeatedly switch the potential difference through which ions pass prior to entering the first ion guide between a high fragmentation mode of operation wherein ions are substantially fragmented upon entering the first ion guide and a low fragmentation mode of operation wherein substantially less ions are fragmented or wherein substantially no ions are fragmented upon entering the first ion guide.

In the high fragmentation mode of operation ions entering the first ion guide are preferably accelerated through a potential difference selected from the group consisting of: (i) ≥10 V; (ii) ≥20 V; (iii) ≥30 V; (iv) ≥40 V; (v) ≥50 V; (vi) ≥60 V; (vii) ≥70 V; (viii) ≥80 V; (ix) ≥90 V; (x) ≥100 V; (xi) ≥110 V; (xii) ≥120 V; (xiii) ≥130 V; (xiv) ≥140 V; (xv) ≥150 V; (xvi) ≥160 V; (xvii) ≥170 V; (xviii) 180 V; (xix) ≥190 V; and (xx) ≥200 V.

In the low fragmentation mode of operation ions entering the first ion guide are preferably accelerated through a potential difference selected from the group consisting of: (i) ≤20 V; (ii) ≤15 V; (iii) ≤10 V; (iv) ≤5V; and (v) ≤1V.

The control system is preferably arranged and adapted to switch the first ion guide between the high fragmentation mode of operation and the low fragmentation mode of operation at least once every 1 ms, 5 ms, 10 ms, 15 ms, 20 ms, 25 ms, 30 ms, 35 ms, 40 ms, 45 ms, 50 ms, 55 ms, 60 ms, 65 ms, 70 ms, 75 ms, 80 ms, 85 ms, 90 ms, 95 ms, 100 ms, 200 ms, 300 ms, 400 ms, 500 ms, 600 ms, 700 ms, 800 ms, 900 ms, 1 s, 2 s, 3 s, 4 s, 5 s, 6 s, 7 s, 8 s, 9 s or 10 s.

The first ion guide is preferably arranged and adapted to receive a beam of ions from the mass selective ion trap or mass analyser and to convert or partition the beam of ions such that at least 1, 2, 3, 4, 5, 6, 7, 8, 9, 10, 11, 12, 13, 14, 15, 16, 17, 18, 19 or 20 separate groups or packets of ions are confined and/or isolated in the first ion guide at any particular time, and wherein each group or packet of ions is separately confined and/or isolated in a separate axial potential well formed in the first ion guide.

According to an embodiment the average mass to charge ratio of ions in each of the groups or packets of ions confined and/or isolated in the first ion guide progressively increases or decreases with time and/or progressively increases or decreases from the exit region of the first ion guide towards the entrance region of the first ion guide.

The first voltage means is preferably arranged and adapted to create at least 1, 2, 3, 4, 5, 6, 7, 8, 9, 10, 11, 12, 13, 14, 15, 16, 17, 18, 19 or 20 separate axial potential wells which are substantially simultaneously translated along at least 5%, 10%, 15%, 20%, 25%, 30%, 35%, 40%, 45%, 50%, 55%, 60%, 65%, 70%, 75%, 80%, 85%, 90%, 95% or 100% of the length of the first ion guide.

The first ion guide is preferably arranged and adapted to retain and/or confine and/or partition ions emerging from the mass selective ion trap or mass analyser and to translate ions in one or more groups or packets of ions along at least 5%, 10%, 15%, 20%, 25%, 30%, 35%, 40%, 45%, 50%, 55%, 60%, 65%, 70%, 75%, 80%, 85%, 90%, 95% or 100% of the axial length of the first ion guide whilst either: (i) substantially maintaining the order and/or fidelity in which ions emerge from the mass selective ion trap or mass analyser; and/or (ii) substantially maintaining the composition of ions as one or more groups or packets of ions are translated along the first ion guide.

According to an embodiment the first ion guide is arranged and adapted to collisionally cool, substantially thermalise or substantially reduce the kinetic energy of ions within the first ion guide.

The mass spectrometer preferably further comprises an ion trap upstream of the mass selective ion trap or mass analyser.

The ion trap is preferably arranged and adapted to repeatedly pulse ions into the mass selective ion trap or mass analyser.

The second ion guide preferably has a cycle time which either: (i) substantially corresponds with a cycle or a scan time of the mass selective ion trap or mass analyser; or (ii) substantially differs from a cycle time or a scan time of the mass selective ion trap or mass analyser. The second ion guide may be operated in a synchronised or an asynchronised manner with relation to the mass selective ion trap or mass analyser.

In a mode of operation the second ion guide is preferably arranged and adapted to trap, store or accumulate ions in an ion trapping region located towards, near or substantially at the exit of the second ion guide.

Ions are preferably periodically released from the ion trapping region of the second ion guide and are passed, transmitted or ejected to the mass selective ion trap or mass analyser.

The mass spectrometer preferably further comprises means arranged and adapted to maintain at least a portion of the second ion guide at a pressure selected from the group consisting of: (i) >0.0001 mbar; (ii) >0.001 mbar; (iii) >0.01 mbar; (iv) >0.1 mbar; (v) >1 mbar; (vi) >10 mbar; (vii) 0.0001-0.1 mbar; and (viii) 0.001-0.01 mbar.

According to an embodiment acceleration means are preferably provided which are arranged and adapted to accelerate ions into the second ion guide so that at least some ions are caused to fragment upon entering the second ion guide.

The mass spectrometer preferably further means arranged and adapted to optimise the energy of ions prior to entering the second ion guide so that the ions are caused to fragment in a substantially optimal manner.

The mass spectrometer preferably further comprises a control system arranged and adapted to switch or repeatedly switch the potential difference through which ions pass prior to entering the second ion guide between a first mode of operation wherein ions are substantially fragmented upon entering the second ion guide and a second mode of operation wherein substantially fewer ions are fragmented or wherein substantially no ions are fragmented upon entering the second ion guide.

In the first mode of operation ions entering the second ion guide are preferably accelerated through a potential difference selected from the group consisting of: (i) ≥10 V; (ii) ≥20 V; (iii) ≥30 V; (iv) ≥40 V; (v) ≥50 V; (vi) ≥60 V; (vii) ≥70 V; (viii) ≥80 V; (ix) ≥90 V; (x) ≥100 V; (xi) ≥110 V; (xii) ≥120 V; (xiii) ≥130 V; (xiv) ≥140 V; (xv) ≥150 V; (xvi) ≥160 V; (xvii) ≥170 V; (xviii) ≥180 V; (xix) ≥190 V; and (xx) ≥200 V.

In the second mode of operation ions entering the second ion guide are accelerated through a potential difference selected from the group consisting of: (i) ≤20 V; (ii) ≤15 V; (iii) ≤10 V; (iv) ≤5V; and (v) ≤1V.

The control system is preferably arranged and adapted to switch the second ion guide between the first mode of operation and the second mode of operation at least once every 1 ms, 5 ms, 10 ms, 15 ms, 20 ms, 25 ms, 30 ms, 35 ms, 40 ms, 45 ms, 50 ms, 55 ms, 60 ms, 65 ms, 70 ms, 75 ms, 80 ms, 85 ms, 90 ms, 95 ms, 100 ms, 200 ms, 300 ms, 400 ms, 500 ms, 600 ms, 700 ms, 800 ms, 900 ms, 1 s, 2 s, 3 s, 4 s, 5 s, 6 s, 7 s, 8 s, 9 s or 10 s.

The mass spectrometer preferably further comprises a fragmentation or collision cell for fragmenting ions by Collision Induced Dissociation ("CID") upon colliding with or impacting gas or other molecules.

The mass spectrometer may comprise a collision, fragmentation or reaction device selected from the group consisting of: (i) a Surface Induced Dissociation ("SID") fragmentation device; (ii) an Electron Transfer Dissociation fragmentation device; (iii) an Electron Capture Dissociation fragmentation device; (iv) an Electron Collision or Impact Dissociation fragmentation device; (v) a Photo Induced Dissociation ("PID") fragmentation device; (vi) a Laser Induced Dissociation fragmentation device; (vii) an infrared radiation induced dissociation device; (viii) an ultraviolet radiation induced dissociation device; (ix) a nozzle-skimmer interface fragmentation device; (x) an in-source fragmentation device; (xi) an ion-source Collision Induced Dissociation fragmentation device; (xii) a thermal or temperature source fragmentation device; (xiii) an electric field induced fragmentation device; (xiv) a magnetic field induced fragmentation device; (xv) an enzyme digestion or enzyme degradation fragmentation device; (xvi) an ion-ion reaction fragmentation device; (xvii) an ion-molecule reaction fragmentation device; (xviii) an ion-atom reaction fragmentation device; (xix) an ion-metastable ion reaction fragmentation device; (xx) an ion-metastable molecule reaction fragmentation device; (xxi) an ion-metastable atom reaction fragmentation device; (xxii) an ion-ion reaction device for reacting ions to form adduct or product ions; (xxiii) an ion-molecule reaction device for reacting ions to form adduct or product ions; (xxiv) an ion-atom reaction device for reacting ions to form adduct or product ions; (xxv) an ion-metastable ion reaction device for reacting ions to form adduct or product ions; (xxvi) an ion-metastable molecule reaction device for reacting ions to form adduct or product ions; and (xxvii) an ion-metastable atom reaction device for reacting ions to form adduct or product ions.

A reaction device should be understood as comprising a device wherein ions, atoms or molecules are rearranged or reacted so as to form a new species of ion, atom or molecule. An X-Y reaction fragmentation device should be understood as meaning a device wherein X and Y combine to form a product which then fragments. This is different to a fragmentation device per se wherein ions may be caused to fragment without first forming a product. An X-Y reaction device should be understood as meaning a device wherein X and Y combine to form a product and wherein the product does not necessarily then fragment.

The mass spectrometer may comprise a mass filter, a quadrupole rod set mass filter or analyser, a Time of Flight mass filter or mass analyser, a Wein filter or a magnetic sector mass filter or mass analyser arranged upstream and/or downstream of the second ion guide.

According to an embodiment there is provided a transfer device, an Einzel lens or ion optical lens arrangement arranged between the first ion guide and the mass analyser.

The mass spectrometer preferably further comprises an ion source. The ion source is preferably selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation On Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion ion guide into the Time of Flight mass analyser at a first time and arrive in a region in the vicinity of the pusher and/or puller electrode and wherein the pusher and/or puller electrode is then energised after a delay time subsequent to the first time.

The mass analyser may be arranged and adapted such that the delay time is progressively varied, increased or decreased.

The delay time may be set such that ions having a desired charge state are substantially orthogonally accelerated whereas ions having an undesired charge state are not substantially orthogonally accelerated, wherein the desired charge state and/or the undesired charge state are selected from the group consisting of: (i) ions having a single charge; (ii) ions having two charges; (iii) ions having three charges; (iv) ions having four charges; (v) ions having five charges; (vi) ions having more than five charges; and (vii) multiply charged ions.

A first plurality of ions are preferably pulsed into the mass selective ion trap or mass analyser and prior to a second plurality of ions being pulsed into the mass selective ion trap or mass analyser the pusher and/or puller electrode is energised at least x times, wherein x is selected from the group consisting of: (i) 1; (ii) 2-10; (iii) 10-20; (iv) 20-30; (v) 30-40; (vi) 40-50; (viii) 50-60; (ix) 60-70; (x) 70-80; (xi) 80-90; (xii) 90-100; (xiii) 100-110; (xiv) 110-120; (xv) 120-130; (xvi) 130-140; (xvii) 140-150; (xviii) 150-160; (xix) 160-170; (xx) 170-180; (xxi) 180-190; (xxii) 190-200; (xxiii) 200-210; (xxiv) 210-220; (xxv) 220-230; (xxvi) 230-240; (xxvii) 240-250; and (xxviii) >250.

The pusher and/or puller electrode is preferably energised once every 0-10 μs, 10-20 μs, 20-30 μs, 30-40 μs, 40-50 μs, 50-60 μs, 60-70 μs, 70-80 μs, 80-90 μs, 90-100 μs, 100-110 μs, 110-120 μs, 120-130 μs, 130-140 μs, 140-150 μs, 150-160 μs, 160-170 μs, 170-180 μs, 180-190 μs, 190-200 μs, 200-210 μs, 210-220 μs, 220-230 μs, 230-240 μs, 240-250 μs, 250-260 μs, 260-270 μs, 270-280 μs, 280-290 μs, 290-300 μs or >300 μs.

The pusher and/or puller electrode is preferably energized at least 1, 2, 3, 4, 5, 6, 7, 8, 9, 10, 11, 12, 13, 14, 15, 16, 17, 18, 19, 20 or >20 times for every 1, 2, 3, 4, 5, 6, 7, 8, 9, 10, 11, 12, 13, 14, 15, 16, 17, 18, 19, 20 or >20 axial potential wells which are translated to the end of the first ion guide such that ions are caused to be emitted or otherwise ejected from the first ion guide.

According to an embodiment a first plurality of ions may be pulsed into the mass selective ion trap or mass analyser and prior to a second plurality of ions being pulsed into the mass selective ion trap or mass analyser at least y separate axial potential wells are created or formed in the first ion guide and/or are translated along at least a portion of the axial length of the first ion guide, wherein y is selected from the group consisting of: (i) 1; (ii) 2-10; (iii) 10-20; (iv) 20-30; (v) 30-40; (vi) 40-50; (viii) 50-60; (ix) 60-70; (x) 70-80; (xi) 80-90; (xii) 90-100; (xiii) 100-110; (xiv) 110-120; (xv) 120-130; (xvi) 130-140; (xvii) 140-150; (xviii) 150-160; (xix) 160-170; (xx) 170-180; (xxi) 180-190; (xxii) 190-200; (xxiii) 200-210; (xxiv) 210-220; (xxv) 220-230; (xxvi) 230-240; (xxvii) 240-250; and (xxviii) >250.

The mass analyser may be selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic or orbitrap mass analyser; (x) a Fourier Transform electrostatic or orbitrap mass analyser; and (xi) a Fourier Transform mass analyser.

According to an embodiment there is preferably provided processing means wherein the processing means is arranged and adapted to filter mass spectral data obtained by the mass analyser so that a mass spectrum is produced comprising mass spectral data relating to: (i) ions having a single charge; (ii) ions having two charges; (iii) ions having three charges; (iv) ions having four charges; (v) ions having five charges; (vi) ions having more than five charges; and (vii) multiply charged ions.

According to an aspect of the present invention there is provided a method of mass spectrometry comprising:

mass selectively ejecting ions from a mass selective ion trap or mass analyser;

receiving ions from the mass selective ion trap or mass analyser into a first ion guide arranged downstream of the mass selective ion trap or mass analyser, the first ion guide comprising a plurality of electrodes;

applying one or more voltages or one or more voltage waveforms to the electrodes of the first ion guide so that in a first mode of operation ions received from the mass selective ion trap or mass analyser are retained and/or confined and/or transported and/or translated in separate regions or portions of the first ion guide; and providing a mass analyser downstream of the first ion guide.

According to an aspect of the present invention there is provided a mass spectrometer comprising an ion guide arranged downstream of a mass selective ion trap or mass analyser, wherein in use one or more transient DC voltages or potentials or one or more transient DC voltage or potential waveforms are applied to the ion guide in order to create a plurality of axial potential wells in the ion guide.

According to an aspect of the present invention there is provided a mass spectrometer comprising an ion guide arranged downstream of a mass selective ion trap or mass analyser, wherein in use two or more phase-shifted AC or RF voltages are applied to the ion guide in order to create a plurality of axial potential wells in the ion guide.

According to an aspect of the present invention there is provided a mass spectrometer comprising an ion guide arranged downstream of a mass selective ion trap or mass analyser, wherein in use a plurality of axial potential wells are created in the ion guide and/or are translated along the ion guide.

According to an aspect of the present invention there is provided a method of mass spectrometry comprising:

providing an ion guide downstream of a mass selective ion trap or mass analyser;

mass selectively ejecting ions from the mass selective ion trap or mass analyser; and applying one or more transient DC voltages or potentials or one or more transient DC voltage or potential waveforms to the ion guide in order to create a plurality of axial potential wells in the ion guide.

According to an aspect of the present invention there is provided a method of mass spectrometry comprising:

providing an ion guide arranged downstream of a mass selective ion trap or mass analyser;

mass selectively ejecting ions from the mass selective ion trap or mass analyser; and applying two or more phase-shifted AC or RF voltages to the ion guide in order to create a plurality of axial potential wells in the ion guide.

According to an aspect of the present invention there is provided a method of mass spectrometry comprising:

providing an ion guide arranged downstream of a mass selective ion trap or mass analyser;

mass selectively ejecting ions from the mass selective ion trap or mass analyser; and creating a plurality of axial potential wells in the ion guide and/or translating a plurality of axial potential wells along the ion guide.

According to a preferred embodiment ions having specific mass to charge ratios are preferably mass selectively ejected or emitted from a mass selective ion trap or mass analyser whilst other ions having different mass to charge ratios remain trapped within the mass selective ion trap or mass analyser. Substantially all the ions ejected or emitted from the mass selective ion trap or mass analyser are then preferably orthogonally accelerated into the orthogonal acceleration drift or flight region of an orthogonal acceleration Time of Flight mass analyser.

The method according to the preferred embodiment preferably comprises mass selectively ejecting ions from a mass selective ion trap or mass analyser and collecting at least some of the ions emitted from the mass selective ion trap or mass analyser in an ion guide. Ions are preferably radially confined in the ion guide by the application of an inhomogeneous AC or RF electric field to the electrodes comprising the ion guide. According to the preferred embodiment ions are preferably partitioned into groups or packets with a series of potential hills or barriers preferably separating each group or packet or ions within the ion guide. Ions are preferably partitioned or separated into various groups or packets according to their ejection times from the mass selective ion trap or mass analyser. The average mass to charge ratio of the ions within each axial potential well preferably varies.

Ions are preferably collisionally cooled within the ion guide. The ions are preferably transported along or through the ion guide by being propelled forwards by the series of potential hills or barriers which are preferably arranged to move or otherwise be translated along the axis or axial length of the ion guide.

According to an embodiment a mass spectrum is preferably obtained using a Time of Flight mass analyser. The mass analyser preferably mass analyses the mass to charge ratios of the ions which were contained in one or more of the groups or packets of ions which were translated along the length of the ion guide.

In a conventional mass spectrometer comprising an orthogonal acceleration Time of Flight mass analyser, ions having approximately the same energy are arranged to pass through an orthogonal acceleration region in which an orthogonal acceleration field is periodically applied. The length of the orthogonal acceleration region, the energy of the ions as they pass through the orthogonal acceleration region and the frequency of the application of the orthogonal acceleration electric field determine the sampling duty cycle for sampling ions for subsequent analysis by the Time of Flight mass analyser.

Ions possessing approximately the same energy but having different mass to charge ratios will have different velocities and will therefore have different sampling duty cycles.

An aspect of the preferred embodiment is that ions are preferably arranged so as to be released as a succession of packets from the ion guide such that the ions in each packet of ions have a relatively narrow range of mass to charge ratios and therefore velocities. Accordingly, all the ions contained within a packet of ions are preferably arranged so as to arrive at the orthogonal acceleration region such that when an orthogonal acceleration electric field is applied then substantially all the ions are then orthogonally accelerated into the drift or flight region of the Time of Flight mass analyser. As a result a high sampling duty cycle can be achieved.

In order to achieve a high sampling duty cycle, the range of mass to charge ratios of ions within each packet of ions should preferably be arranged so as to be relatively narrow. This may be achieved by appropriate choice of the scanning or stepping rate of the mass selective ion trap or mass analyser.

The energy spread of the ions within each packet of ions is also preferably arranged to be relatively low. This may be achieved, for example, by collisional cooling of ions in the ion guide.

Each packet of ions is preferably released from the ion guide upstream of the Time of Flight mass analyser such that the time for the ions to arrive at the orthogonal acceleration region of the Time of Flight mass analyser is preferably relatively short. Accordingly, ions preferably do not have much time in which to disperse. As a result the ions from each packet of ions released from the ion guide are preferably axially dispersed to a smaller extent than the length of the orthogonal acceleration region of the Time of Flight mass analyser. This may be achieved by making the distance from the point of release of ions from the ion guide to the orthogonal acceleration region of the Time of Flight mass analyser relatively short given the energy of the ions and the range of mass to charge ratios within each packet of ions released from the ion guide.

According to the preferred embodiment the orthogonal acceleration electric field which is preferably applied across the orthogonal acceleration region of the Time of Flight mass analyser is preferably applied in synchronism with the arrival of the ions in the orthogonal acceleration region.

According to the preferred embodiment is possible to achieve a sampling duty cycle of substantially 100% for all the ions in a packet of ions released from the ion guide upstream of the Time of Flight mass analyser. If the same or optimum conditions are arranged so as to apply to each packet of ions released from the ion guide then a sampling duty cycle of substantially 100% may be achieved for all the ions in all the packets of ions released from the ion guide.

The preferred embodiment comprises a mass selective ion trap or mass analyser coupled to an orthogonal acceleration Time of Flight mass analyser in order to provide a relatively high or a substantially 100% sampling duty cycle. An ion guide is preferably provided intermediate the mass selective ion trap or mass analyser and the orthogonal acceleration Time of Flight mass analyser.

According to the preferred embodiment one or more transient DC voltages or potentials or one or more transient DC voltage or potential waveforms are preferably applied to the electrodes comprising the ion guide. Ions are preferably transported along the ion guide by a succession of potential hills or barriers which are preferably arranged to move along or otherwise be translated along the axis of the ion guide.

The mass selective ion trap or mass analyser and the ion guide are preferably sufficiently closely coupled such that the ions emerging at the exit of the mass selective ion trap or mass analyser are preferably transported in a succession of packets along the ion guide in substantially the same order that they emerge from the mass selective ion trap or mass analyser.

The orthogonal acceleration Time of Flight mass analyser is preferably positioned downstream of the ion guide. The ion guide and the orthogonal acceleration Time of Flight mass analyser are preferably sufficiently closely coupled such that each packet of ions released from the ion guide is preferably sampled by the orthogonal acceleration Time of Flight mass spectrometer with substantially a 100% sampling duty cycle.

The mass selective ion trap or mass analyser may be arranged to release ions having a relatively narrow range of mass to charge ratios in a series of discrete packets. Alternatively, the mass selective ion trap or mass analyser may be scanned such as to release ions in sequence according to their mass to charge ratio. The mass selective ion trap or mass analyser may be scanned from a relatively low mass to charge ratio value to a relatively high mass to charge ratio value. Alternatively, the mass selective ion trap or mass analyser may be scanned from a relatively high mass to charge ratio value to a relatively low mass to charge ratio value.

The scan time of the mass selective ion trap or mass analyser may be between 1 ms and 1 s, preferably between 5 and 200 ms, more preferably between 10 and 100 ms. The cycle time for a Time of Flight mass measurement experiment may be between 10 and 250 μs, preferably between 20 and 125 μs, further preferably about 50 μs.

According to an embodiment the scan time of the mass selective ion trap or mass analyser may be set at 20 ms. Ions emerging from the mass selective ion trap or mass analyser may be arranged to be collected in one of 400 packets or axial potential wells which are preferably successive created within the ion guide arranged downstream of the mass selective ion trap or mass analyser. Each axial potential well created within the ion guide may be arranged to have a cycle time of 50 μs. For each potential well which is translated along the length of the ion guide there is preferably a corresponding cycle of orthogonally accelerating or injecting ions into the orthogonal acceleration or drift region of the Time of Flight mass analyser.

The delay time between the release of a packet of ions from the ion guide and the application of the orthogonal acceleration electric field to the orthogonal acceleration region (or the application of a pusher voltage to the pusher and/or puller electrode) may be arranged so as to progressively vary with each cycle according to the mass to charge ratio of the ions of interest within each packet being released from the ion guide.

An ion source may be arranged upstream of the mass selective ion trap or mass analyser. The ion source may comprise a pulsed ion source such as a Laser Desorption Ionisation ("LDI"), a Matrix Assisted Laser Desorption Ionisation ("MALDI") ion source or a Desorption Ionisation on Silicon ("DIOS") ion source.

Alternatively, a continuous ion source may be provided in which case an ion trap for storing ions and periodically releasing ions to the mass selective ion trap or mass analyser may also be provided. The continuous ion source may comprise an Electrospray Ionisation ("ESI") ion source, an Atmospheric Pressure Chemical Ionisation ("APCI") ion source, an Electron Impact ("EI") ion source, an Atmospheric Pressure Photon Ionisation ("APPI") ion source, a Chemical Ionisation ("CI") ion source, a Fast Atom Bombardment ("FAB") ion source, a Liquid Secondary Ion Mass Spectrometry ("LSIMS") ion source, a Field Ionisation ("FI") ion source or a Field Desorption ("FD") ion source. Other continuous or pseudo-continuous ion sources may also be provided.

A mass filter may be provided downstream of the ion source and upstream of the ion trap. This may be used to transmit parent or precursor ions having a single mass to charge ratio or having a specific range of mass to charge ratios. The mass filter may comprise a multipole rod set, a quadrupole mass filter, a Time of Flight mass filter, a Wein filter, or a magnetic sector mass filter.

The mass spectrometer may include a collision, fragmentation or reaction device upstream of the ion trap. In one mode of operation at least some ions entering the collision, fragmentation or reaction device are preferably caused to fragment or react.

BRIEF DESCRIPTION OF THE DRAWINGS

Various embodiments of the present invention will now be described, by way of example only, and with reference to the accompanying drawings in which.

DETAILED DESCRIPTION OF THE PREFERRED EMBODIMENTS

Figure 1:
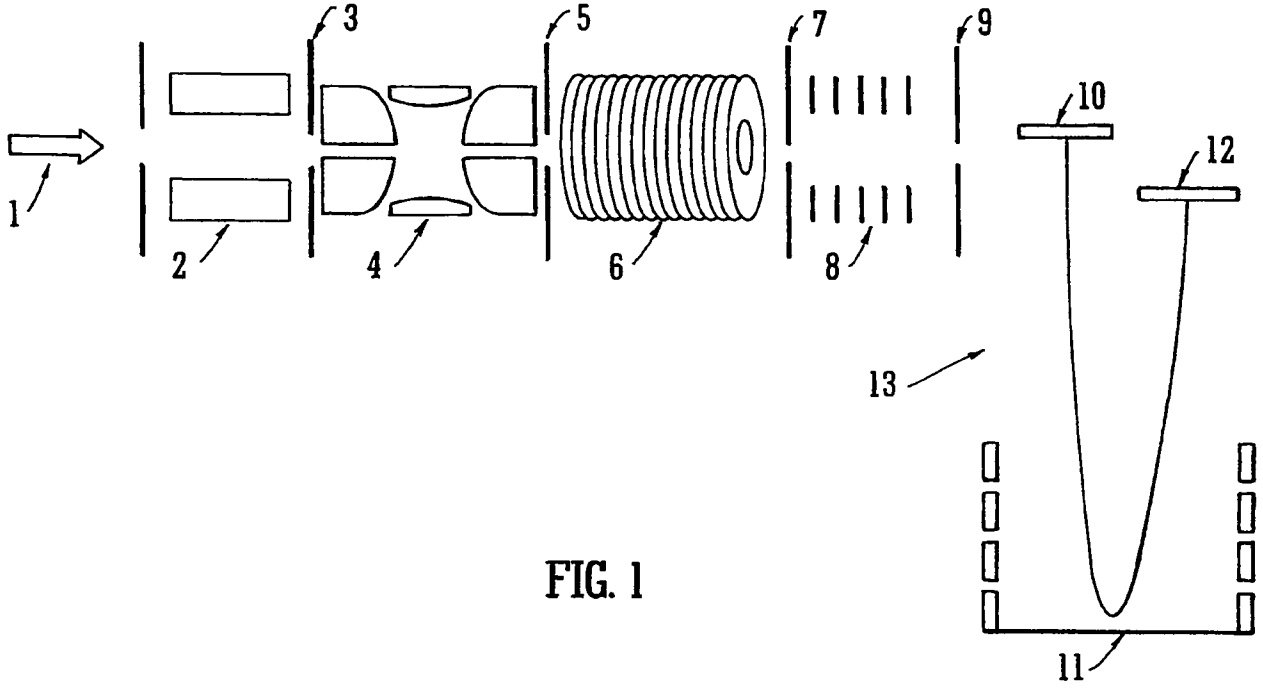
FIG. 1 shows a first embodiment of the present invention comprising an ion trap, a mass selective ion trap or mass analyser, an ion guide arranged downstream of the mass selective ion trap or mass analyser and an orthogonal acceleration Time of Flight mass analyser arranged downstream of the ion guide.

A first embodiment of the present invention will be described with reference to FIG. 1. A continuous ion source such as an Electrospray ion source is preferably provided which preferably generates a beam of ions 1. The beam of ions 1 is preferably passed to a first ion trap 2 which is preferably arranged upstream of a mass selective ion trap or mass analyser 4. Ions are preferably trapped in the first ion trap 2 and are then preferably pulsed out of the first ion trap 2 by the application of an extraction voltage to an ion gate 3 which is preferably arranged at the exit or downstream of the first ion trap 2.

The first ion trap 2 may comprise a quadrupole rod set or other multipole rod set. The first ion trap 2 may preferably have a length of approximately 75 mm. According to a particularly preferred embodiment the first ion trap 2 may comprise an ion tunnel ion trap comprising a plurality of electrodes having apertures therein through which ions are transmitted in use. The apertures are preferably all the same size. In other embodiments at least 60%, 65%, 70%, 75%, 80%, 85%, 90% or 95% of the electrodes of the first ion trap 2 have apertures which are substantially the same size. The first ion trap 2 may preferably comprise approximately 50 electrodes. Adjacent electrodes of the first ion trap 2 are preferably connected to opposite phases of a two-phase AC or RF voltage supply so that ions are radially confined in use within the first ion trap 2. The AC or RF voltage supply preferably has a frequency within the range 0.1-3.0 MHz, preferably 0.3-2.0 MHz, further preferably 0.5-1.5 MHz.

In the preferred embodiment the electrodes comprising the first ion trap 2 are preferably maintained at a DC voltage $V_{rf1}$. The ion gate 3 arranged downstream of the first ion trap 2 is preferably normally held at a higher DC voltage $V_{trap}$ than the voltage $V_{rf1}$ at which the electrodes of the first ion trap 2 are preferably maintained. The voltage applied to the ion gate 3 is preferably periodically dropped to a voltage $V_{extract}$ which is preferably lower than the voltage $V_{rf1}$. As a result, ions are preferably caused to be accelerated out of the first ion trap 2 and to be admitted into the mass selective ion trap or mass analyser 4. The voltage applied to the ion gate 3 may be dropped for a relatively short period of time such that ions are caused to be ejected from the first ion trap 2 in a substantially pulsed manner and preferably are pulsed into the mass selective ion trap or mass analyser 4.

In less preferred embodiments, a pulsed ion source such as a Matrix Assisted Laser Desorption Ionisation ("MALDI") ion source or a Laser Desorption Ionisation ion source may be used instead of a continuous ion source. If a pulsed ion source is used then the first ion trap 2 and associated ion gate 3 may be omitted.

The mass selective ion trap or mass analyser 4 is preferably arranged to mass selectively eject or emit ions according to their mass to charge ratio. The mass selective ion trap or mass analyser 4 preferably comprises a 3D quadrupole or Paul ion trap mass analyser as shown in FIG. 1. Alternatively, the mass selective ion trap or mass analyser 4 may comprise a cylindrical ion trap or mass analyser, a cubic ion trap or mass analyser, a 2D or linear quadrupole ion trap or mass analyser or various configurations employing both DC and RF ion confining fields.

Typical scan times for the mass selective ion trap or mass analyser 4 may be of the order of several milliseconds to several hundreds of milliseconds. The mass selective ion trap or mass analyser 4 is preferably arranged to sequentially eject or emit ions according to their mass to charge ratio. The mass selective ion trap or mass analyser 4 preferably resonantly excites and resonantly ejects ions. After all the ions have been ejected from the mass selective ion trap or mass analyser 4 a new pulse of ions is preferably admitted to the mass selective ion trap or mass analyser 4 which preferably marks the start of a new cycle of operation. Many cycles may be performed in a single experimental run.

A differential pumping aperture 5 may be provided downstream of the mass selective ion trap or mass analyser 4. An ion guide 6 is preferably arranged downstream of the mass selective ion trap or mass analyser 4 and the differential pumping aperture 5. The ion guide 6 preferably comprises a plurality of electrodes having apertures through which ions are transmitted in use. The apertures of the electrodes forming the ion guide 6 are preferably all the same size. In other embodiments at least 60%, 65%, 70%, 75%, 80%, 85%, 90% or 95% of the electrodes have apertures which are substantially the same size. Adjacent electrodes are preferably connected to the opposite phases of a two-phase AC or RF supply.

One or more transient DC voltages or potentials or one or more transient DC voltage or potential waveforms are preferably applied to one or more of the electrodes of the ion guide 6. One or more potential hills or barriers are preferably created within the ion guide 6. The one or more transient DC voltages or potentials or one or more transient DC voltage waveforms or potentials are preferably progressively applied to a succession of electrodes of the ion guide 6 such that the one or more potential hills or barriers are preferably caused to move along the axis of the ion guide 6 such that ions are propelled towards the exit of the ion guide 6.

The ion guide 6 is preferably provided in a vacuum chamber which is preferably maintained, in use, at a pressure within the range 0.001-0.01 mbar. According to less preferred embodiments, the vacuum chamber may be maintained at a pressure greater than 0.01 mbar up to a pressure at or near 1 mbar. Also, according to less preferred embodiments, the vacuum chamber may alternatively be maintained at a pressure below 0.001 mbar.

The gas pressure in the ion guide 6 is preferably sufficient to impose collisional damping of ion motion but is preferably not sufficient to impose excessive viscous drag on the movement of ions. The amplitude and average velocity of the one or more potential hills or barriers which are preferably translated along the ion guide 6 is preferably such that ions will not slip over a potential hill or barrier. Ions are preferably transported ahead of each travelling potential hill or barrier regardless of their mass, mass to charge ratio or ion mobility.

In another mode of operation ions may be arranged so as to be sufficiently energetic when they enter the ion guide 6 that they collide with gas molecules present in the ion guide 6 and are caused to fragment into fragment or daughter ions. Subsequent mass analysis of the fragment or daughter ions yields valuable mass spectral information about the parent ion(s).

According to an embodiment ions may be arranged so that they enter the ion guide 6 with sufficiently low energies such that they are not caused to substantially fragment.

The energy of ions as they enter the ion guide 6 can be controlled by, for example, setting the level of a voltage or potential difference experienced by the ions prior to entering the ion guide 6. Since the voltage difference can preferably be switched near instantaneously, the ion guide 6 can, in effect, be considered to be switchable between a relatively high fragmentation mode of operation and a relatively low fragmentation mode of operation.

The voltage or potential difference experienced by the ions prior to entering the ion guide 6 may also be varied during the course of scanning ions out of the mass selective ion trap or mass analyser 4. The voltage or potential difference may be set such that the collision energy is optimised for one or more species of ion as they emerge from the mass selective ion trap or mass analyser 4 and are onwardly transmitted to the ion guide 6. Alternatively, the collision energy may be progressively varied during the course of scanning ions out of the mass selective ion trap or mass analyser 4 such that the collision energy is approximately optimised for each species of ion as they emerge from the mass selective ion trap or mass analyser 4 and are preferably accelerated into the ion guide 6.

The voltage or potential difference experienced by ions prior to entering the ion guide 6 may also be switched according to another embodiment between a relatively low value and a relatively high value on successive cycles of scanning ions out of the mass selective ion trap or mass analyser 4. The high value of voltage or potential difference experienced by the ions prior to entering the ion guide 6 may be progressively varied during the course of scanning ions out of the mass selective ion trap or mass analyser 4 such that the collision energy is approximately optimised for each species of ion as it emerges from the mass selective ion trap or mass analyser 4.

According to a preferred embodiment a differential pumping aperture 7 may be provided downstream of the ion guide 6. One or more ion optical lenses 8 may also be provided preferably downstream of the ion guide 6 and the differential pumping aperture 7 in order to accelerate and guide ions through a further differential pumping aperture 9 and into an analyser chamber which preferably contains a mass analyser.

The mass analyser preferably comprises an orthogonal acceleration Time of Flight mass analyser 13 comprising a pusher and/or puller electrode 10 for injecting ions into an orthogonal acceleration drift or flight region. A reflectron 11 is preferably provided at one end of the drift or flight region for reflecting ions travelling through the orthogonal acceleration drift or flight region back towards an ion detector 12 which is preferably positioned in relatively close proximity to the pusher and/or puller electrode 10. As is well known in the art, at least some of the ions in a packet of ions entering an orthogonal acceleration Time of Flight mass analyser are preferably caused to be orthogonally accelerated into the orthogonal acceleration drift or flight region.

Ions preferably become temporally separated in the orthogonal acceleration drift or flight region in a manner which is dependent upon their mass to charge ratio. Ions having a lower mass to charge ratio will travel faster in the drift or flight region than ions having relatively higher mass to charge ratios. Ions having relatively low mass to charge ratios will therefore reach the ion detector 12 prior to ions having relatively higher mass to charge ratios. The time taken for an ion to drift through the drift or flight region and to reach the ion detector 12 can be used to determine accurately the mass to charge ratio of the ion in question. The intensity of ions and their corresponding mass to charge ratios can be used to produce a mass spectrum.

Figure 2A:
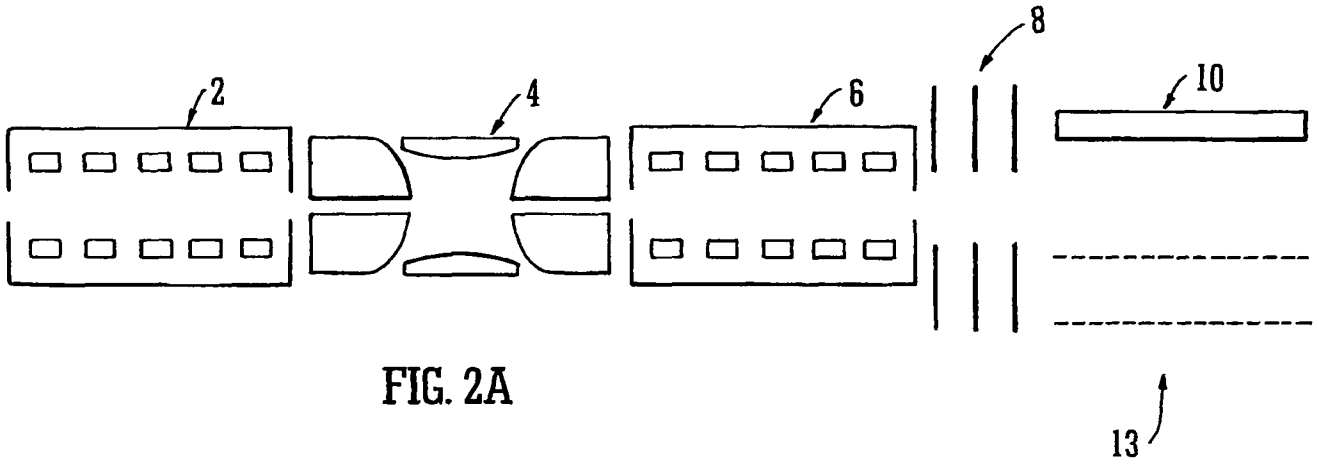
FIG. 2A illustrates the ion trap, mass selective ion trap or mass analyser, ion guide and the orthogonal acceleration stage of the orthogonal acceleration Time of Flight mass analyser according to a preferred embodiment
Figure 2B:
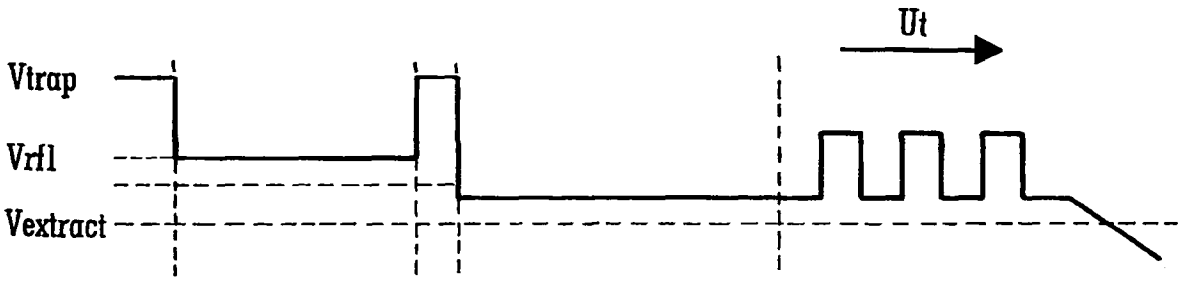
FIG. 2B illustrates the various DC voltage gradients and transient DC voltages which are preferably applied to or maintained across the ion trap, the mass selective ion trap or mass analyser and the ion guide.

FIG. 2A shows in schematic form some of the electrodes of the ion trap 2, the mass selective ion trap or mass analyser 4, the ion guide 6, the optical lens 8 and the pusher electrode 10 of the Time of Flight mass analyser 13. FIG. 2B shows the static and transient DC voltages which are preferably applied to the ion trap 2, the ion gate 3 arranged between the ion trap 2 and the mass selective ion trap or mass analyser 4 and the relative potential at which the electrodes comprising the mass selective ion trap or mass analyser 4, the ion guide 6 and the optical lens 8 are held. A plurality of transient DC voltages or potentials are shown schematically as being applied to the electrodes of the ion guide 6 which is arranged downstream of the mass selective ion trap or mass analyser 4. The static potential or voltage difference maintained across the ion optical lens 8 is also shown.

It is known to store ions in an ion trap and then to eject ions from the ion trap and transmit the ions to an orthogonal acceleration Time of Flight mass analyser. Ions in the packet of ions ejected from the ion trap will become spatially dispersed by the time that they arrive at an orthogonal acceleration region arranged adjacent a pusher electrode of the Time of Flight mass analyser. Ions having a relatively low mass to charge ratio will reach the orthogonal acceleration region prior to ions having a relatively high mass to charge ratio. The pusher electrode may be arranged so as to inject ions into the orthogonal acceleration Time of Flight mass analyser at a predetermined time after the ions were first released from the ion trap. Since the time of arrival of ions at the orthogonal acceleration region is dependent upon the mass to charge ratio of the ions, then it can be arranged such that ions having a certain mass to charge ratio will be injected by the pusher electrode into the orthogonal acceleration Time of Flight mass analyser with a sampling duty cycle of approximately 100% by appropriate setting of the time delay.

Figure 3:
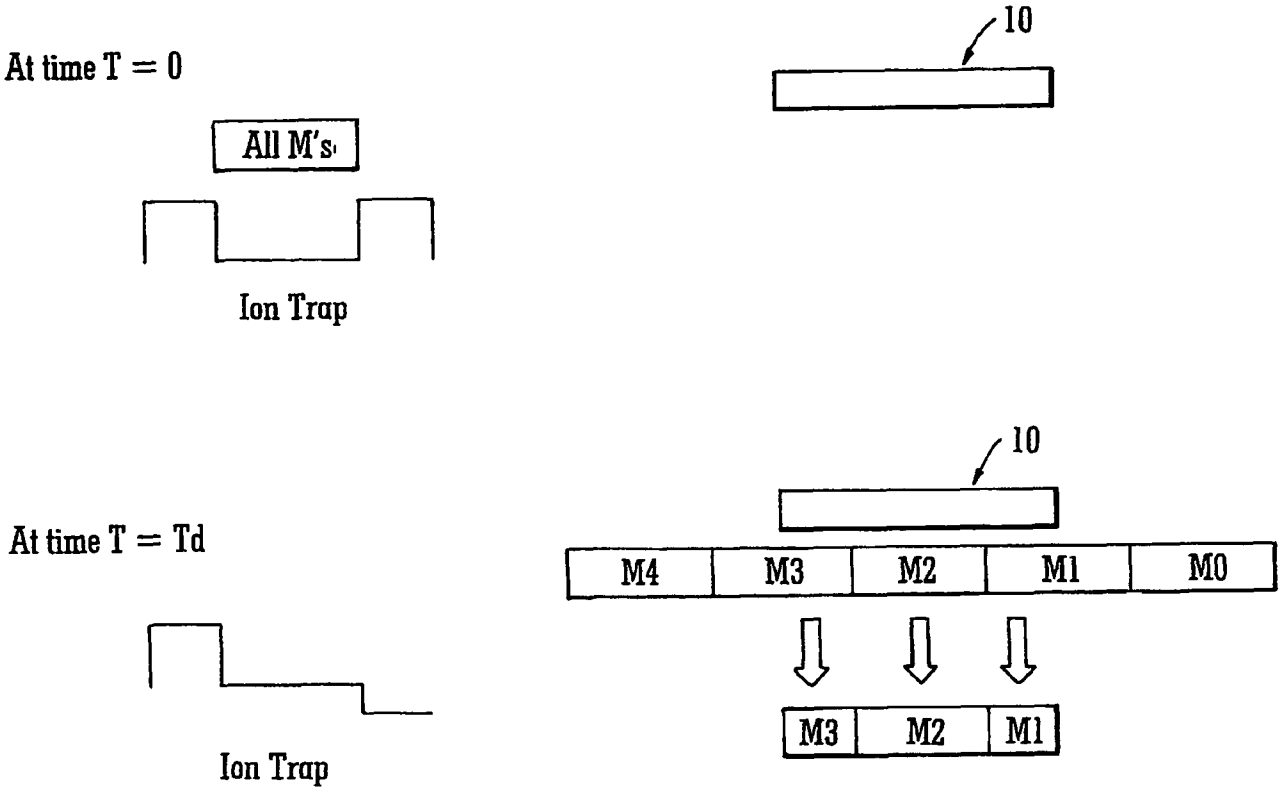
FIG. 3 PRIOR ART
FIG. 3 illustrates a known method of increasing the duty cycle for ions having a narrow range of mass to charge ratios by non-mass selectively releasing ions from an ion trap arranged upstream of an orthogonal acceleration Time of Flight mass analyser and energising the pusher electrode of the orthogonal acceleration Time of Flight mass analyser after a predetermined delay time.

FIG. 3 illustrates how the timing of the energisation of a pusher electrode 10 of a Time of Flight mass analyser may be arranged so that all ions having a specific mass to charge ratio M2 are orthogonally accelerated into the orthogonal acceleration drift or flight region of the Time of Flight mass analyser.

At a time T=0 a packet of ions is non-mass selectively released from the ion trap arranged upstream of the orthogonal acceleration region of the Time of Flight mass analyser. After a certain time Td, ions having a mass to charge ratio M2 will have reached a region adjacent the centre of the pusher electrode of the Time of Flight mass analyser. The pusher electrode 10 is then preferably energised so that ions having a mass to charge ratio M2 are injected or orthogonally accelerated into the orthogonal drift or flight region of the Time of Flight mass analyser. The duty cycle for ions having a mass to charge ratio M2 may be substantially 100%.

Ions having a mass to charge ratio M4 which is greater than M2 will not have reached the orthogonal acceleration region by the time that the pusher electrode 10 is energised. Accordingly, ions having a mass to charge ratio M4 are not injected or orthogonally accelerated into the drift or flight region of the orthogonal acceleration Time of Flight mass analyser. Similarly, ions having a mass to charge ratio M0 which is smaller than M2 will have already passed the pusher electrode 10 by the time that the pusher electrode 10 is energised. Accordingly, ions having a mass to charge ratio M0 will also not be injected or orthogonally accelerated into the drift or flight region of the orthogonal acceleration Time of Flight mass analyser.

Ions having mass to charge ratios M3 and M1, wherein M3 is slightly greater than M2 and wherein M1 is slightly less than M2 will be partially injected or orthogonally accelerated into the orthogonal drift or flight region of the Time of Flight mass analyser.

By adjusting the time delay Td it is possible to optimise the transmission or orthogonal acceleration of ions having any particular mass to charge ratio as desired.

Figure 4:
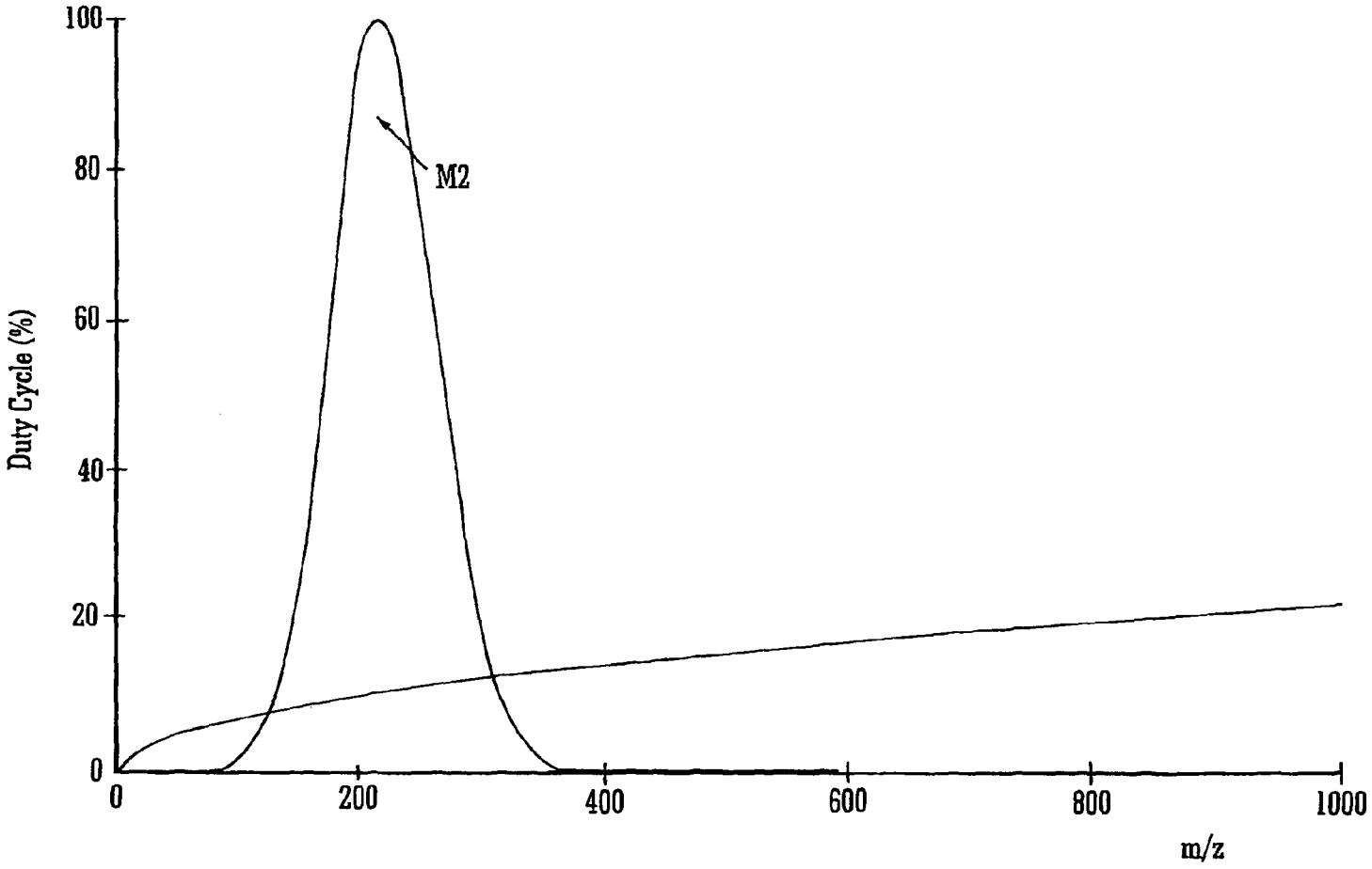
FIG. 4 PRIOR ART
FIG. 4 illustrates the sampling duty cycle M2 obtained by non-mass selectively releasing ions from an ion trap arranged upstream of an orthogonal acceleration Time of Flight mass analyser and arranging for the pusher electrode of the orthogonal acceleration Time of Flight mass analyser to be energised after a predetermined delay time and contrasts this with the relatively low sampling duty cycle which is obtained by passing a continuous beam of ions into the Time of Flight mass analyser and which reaches a maximum of approximately 22.5%.

FIG. 4 shows the sampling duty cycle for the known method of increasing the duty cycle described above wherein ions having a certain mass to charge ratio M2 are orthogonally accelerated with a duty cycle approaching 100% whereas the duty cycle for ions having other mass to charge ratios tails off fairly rapidly to 0%. FIG. 4 also shows the duty cycle which varies between 0% and about 20% which is obtained when a continuous ion beam is admitted into the orthogonal acceleration region of a Time of Flight mass analyser and the pusher electrode is repeatedly pulsed.

According to the preferred embodiment it is possible to obtain a relatively high duty cycle not just for some ions but advantageously for all ions having mass to charge ratios of potential interest.

It will now be illustrated how the combination of a mass selective ion trap or mass analyser 4 coupled to an ion guide 6 wherein one or more transient DC voltages or potentials or one or more transient DC voltage or potential waveforms are applied enables the duty cycle to be improved compared with conventional arrangements. The ion guide 6 is preferably closely coupled to an orthogonal acceleration Time of Flight mass analyser 13. According to a preferred embodiment the orthogonal acceleration Time of Flight mass analyser 13 is preferably arranged to acquire and analyse substantially all ions having a specific charge state or range of charge states as they emerge from the ion guide 6.

Figure 5:
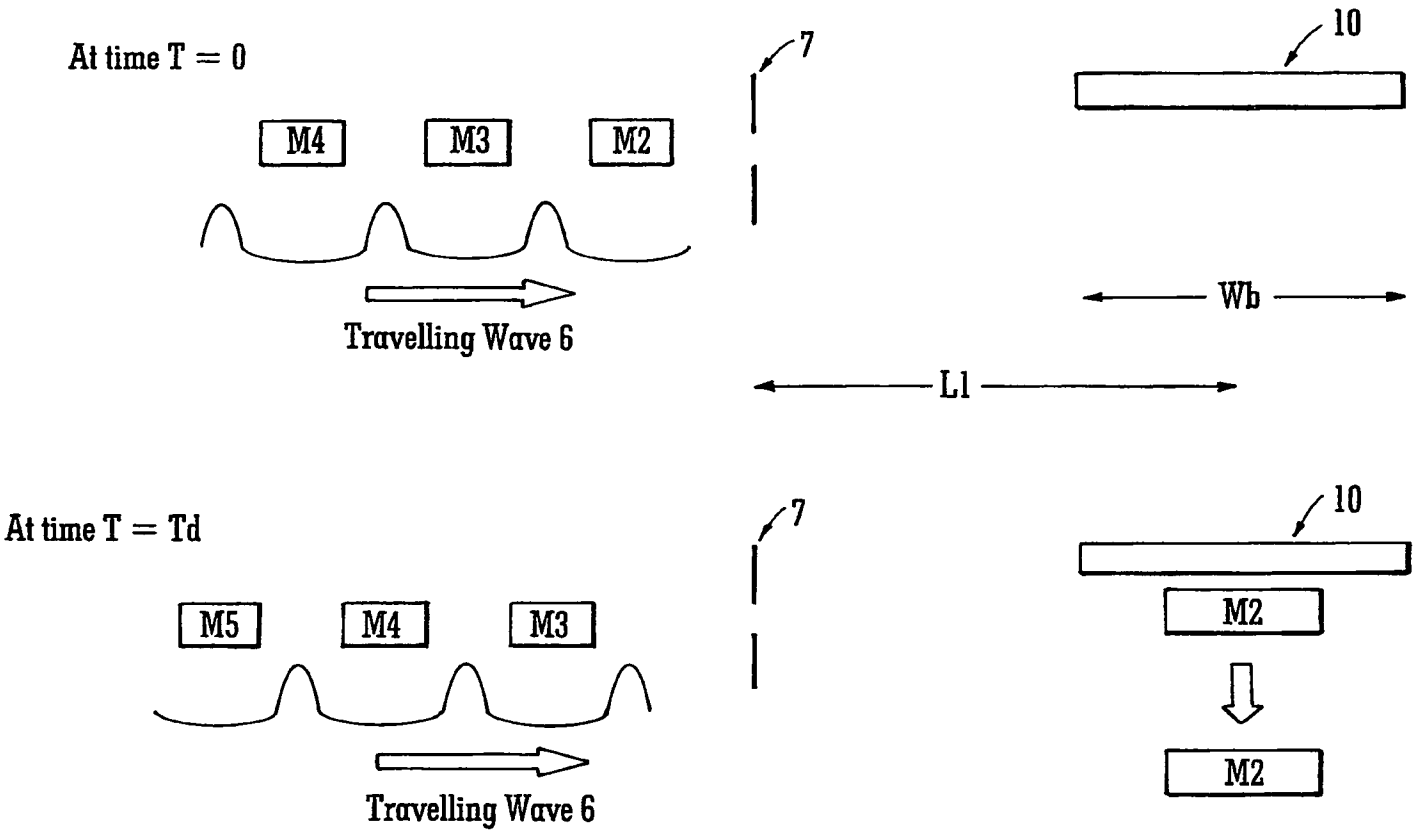
FIG. 5 shows how ions having a narrow range of mass to charge ratios may be released from an ion guide arranged upstream of an orthogonal acceleration Time of Flight mass analyser according to an embodiment of the present invention and wherein the ions released from the ion guide are not significantly spatially dispersed by the time that the ions arrive at an orthogonal acceleration region of an orthogonal acceleration Time of Flight mass analyser.

FIG. 5 illustrates how the timing of the energisation of the pusher electrode 10 of a Time of Flight mass analyser may be arranged so that substantially all ions released from an axial potential well which has reached the end of the ion guide 6 are orthogonally accelerated. Preferably, one or more transient DC voltages or potentials are applied to the ion guide 6. Ions are preferably arranged in groups according to their mass to charge ratio in the ion guide 6. L1 is the distance from the exit of the ion guide 6 or aperture 7 arranged downstream of the ion guide 6 to the centre of the pusher electrode 10. Wb is the width of the pusher electrode 10. At a time T=0 a packet of ions having a mass to charge ratio M2 is released from a potential well which has reached the exit region of the ion guide 6. After a period of time Td ions having mass to charge ratio M2 will have reached an orthogonal acceleration region opposite the pusher electrode 10. The pusher electrode 10 is then preferably energised so that the ions having a mass to charge ratio M2 are preferably injected into the orthogonal drift or flight region of the Time of Flight mass analyser 13. By selecting a suitably short distance L1 and by arranging for the pusher electrode 10 to have a suitably wide width Wb, the spatial spread of the ions of mass to charge ratio M2 as they arrive adjacent the pusher electrode 10 is preferably arranged to be smaller than the width Wb of the pusher electrode 10. Accordingly, when the pusher electrode 10 is energised substantially all the ions are orthogonally accelerated. This results in a sampling duty cycle of substantially 100% for ions having a mass to charge ratio M2. It will be appreciated that if the range of mass to charge ratios of all the ions in a packet of ions released from the ion guide 6 is sufficiently small then all the ions in the packet of ions will occupy a space smaller than width Wb of the pusher electrode 10. Accordingly, a sampling duty cycle of substantially 100% can be obtained for all the ions released from an axial potential well which has been translated to the end of the ion guide 6.

After a packet of ions has been released from the ion guide 6 the pusher electrode 10 is then preferably energised after a pre-determined time delay Td to inject those ions. The predetermined time delay Td is then preferably adjusted as required for the next packet of ions which are preferably released from the ion guide 6. Embodiments are contemplated wherein, for example, 400 packets of ions may be released from the ion guide 6 during the course of a single scan of the mass selective ion trap or mass analyser 4. For sake of illustration only, the scan time of the mass selective ion trap or mass analyser 4 may be 20 ms and ions ejected from the mass selective ion trap or mass analyser 4 may be collected in one of 400 separate packets or potential wells which are preferably created in the ion guide 6 and which are preferably translated along the length of the ion guide 6. Each axial potential well created within the ion guide 6 would have a cycle time of 50 μs. For each axial potential well created within the ion guide 6 there is preferably a corresponding cycle or energisation of the orthogonal acceleration Time of Flight mass analyser. The delay time Td between the release of a packet of ions from the ion guide 6 to the application of an orthogonal acceleration pusher voltage is preferably progressively varied or increased with each cycle according to the mass to charge ratios of the ions of interest contained within each packet within the ion guide 6.

The mass selective ion trap or mass analyser 4 may scan up or down in mass to charge ratio. The delay time Td can be set according to the scan law of the mass selective ion trap or mass analyser 4 and/or the mass to charge ratio of the ions in each packet or potential well within the ion guide 6.

Figure 6:
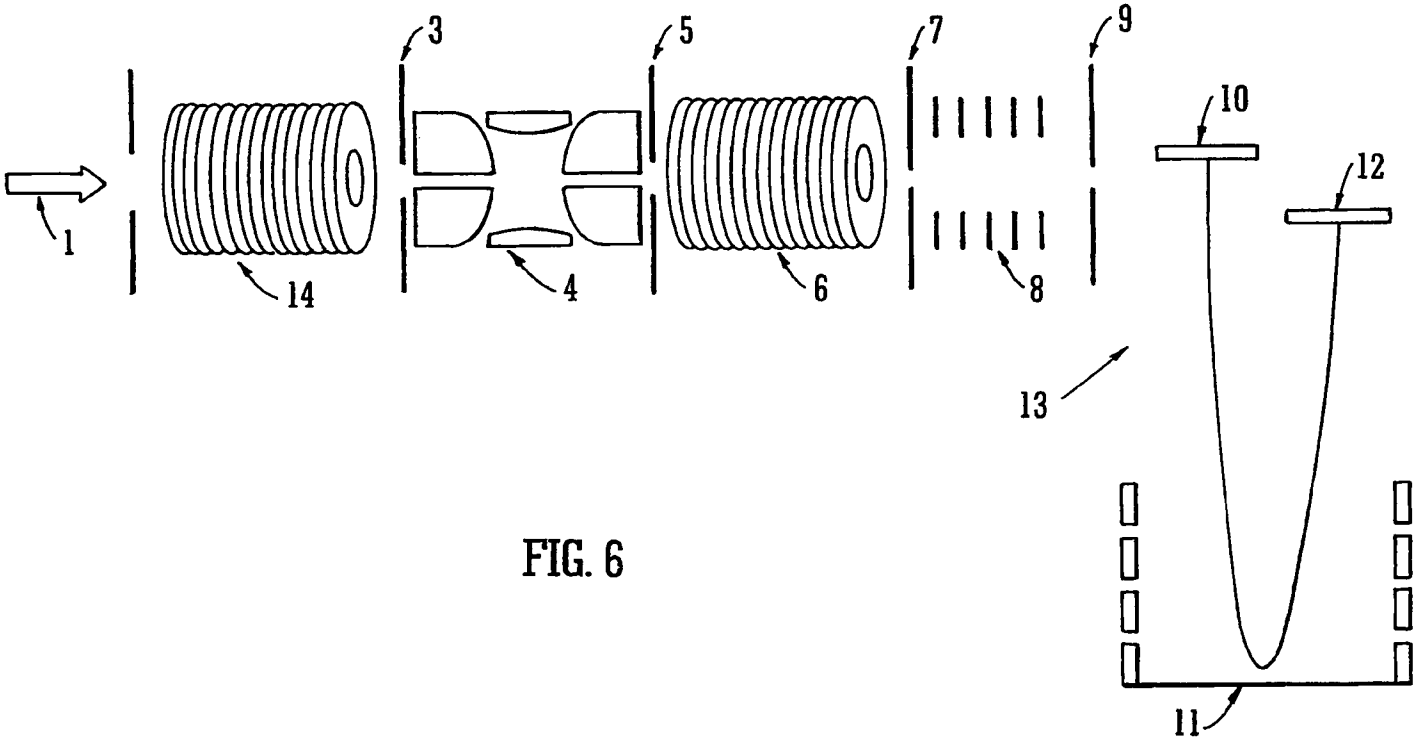
FIG. 6 shows a second embodiment of the present invention wherein a second or additional ion guide is preferably provided upstream of the mass selective ion trap or mass analyser.

FIG. 6 shows a second embodiment of the present invention. The second embodiment is preferably similar to the first embodiment but differs in that the ion trap 2 which may be provided upstream of the mass selective ion trap or mass analyser 4 according to the first embodiment is preferably replaced by a second ion guide 14. The mass selective ion trap or mass analyser 4 and the ion guide 6 arranged downstream of the mass selective ion trap or mass analyser 4 may take any of the forms described above in relation to the first embodiment of the present invention. Similarly, the ion sources described above in relation to the first embodiment may also be used in relation to the second embodiment.

The apertures of the electrodes forming the second ion guide 14 arranged upstream of the mass selective ion trap or mass analyser 4 are preferably all the same size. In other embodiments at least 60%, 65%, 70%, 75%, 80%, 85%, 90% or 95% of the electrodes have apertures which are substantially the same size. Adjacent electrodes of the second ion guide 14 are preferably connected to the opposite phases of a two-phase AC or RF supply. One or more transient DC voltages or potentials or one or more transient DC voltage or potential waveforms are preferably applied to one or more of the electrodes forming the second ion guide 14 in order to form or create one or more potential hills or barriers which are preferably translated along the length of the second ion guide 14.

The one or more transient DC voltages or potentials or the one or more transient DC voltage or potential waveforms are preferably progressively applied to a succession of electrodes of the second ion guide 14 such that the one or more potential hills or barriers preferably move along the axis of the second ion guide 14 in the direction in which the ions are to be propelled or driven.

The second ion guide 14 is preferably provided in a vacuum chamber which is preferably maintained, in use, at a pressure within the range 0.001-0.01 mbar. According to less preferred embodiments, the vacuum chamber may be maintained at a pressure greater than 0.01 mbar up to a pressure at or near 1 mbar. According to another less preferred embodiment the vacuum chamber may alternatively be maintained at a pressure below 0.001 mbar.

The gas pressure is preferably sufficient to impose collisional damping of ion motion, but is preferably not sufficient so as to impose excessive viscous drag on the movement of ions. The amplitude and average velocity of the one or more potential hills or barriers which are preferably translated along the second ion guide 14 is preferably set such that ions will preferably not slip or otherwise pass over a potential hill or barrier. The ions are preferably transported ahead of each travelling potential hill or barrier regardless of their mass, mass to charge ratio or ion mobility.

Ions are preferably transported in the second ion guide 14 and are preferably released in packets into or towards the mass selective ion trap or mass analyser 4. The wave cycle time of the second ion guide 14 may preferably be arranged so as to be equal to the scan time or scan cycle of the mass selective ion trap or mass analyser 4.

Alternatively, ions may be accumulated and held in an ion trapping region preferably arranged near the exit of the second ion guide 14 and may be released to the mass selective ion trap or mass analyser 4 at the start of each scan of the mass selective ion trap or mass analyser 4. In this mode of operation the wave cycle time of the second ion guide 14 may differ from that of the mass selective ion trap or mass analyser 4.

In one mode of operation ions may be arranged such that they are sufficiently energetic when they enter the second ion guide 14 that they collide with gas molecules present in the second ion guide 14 and are caused to fragment into fragment or daughter ions. The resulting fragment or daughter ions may then be onwardly transmitted to the mass selective ion trap or mass analyser 4. The fragment or daughter ions may be arranged so as to be trapped within the mass selective ion trap or mass analyser 4. The fragment or daughter ions may then be progressively scanned out of the mass selective ion trap or mass analyser 4 in preferably a mass-selective manner. The daughter or fragment ions may therefore be caused to be separated or sequentially ejected from the mass selective ion trap or mass analyser 4 according to their mass to charge ratio.

The daughter or fragment ions which are preferably ejected from the mass selective ion trap or mass analyser 4 are then preferably transported by the first ion guide 6 which is preferably arranged downstream of the mass selective ion trap or mass analyser 4. The fragment or daughter ions are preferably received in multiple axial potential wells which are preferably translated along the length of the first ion guide 6 which is preferably arranged downstream of the mass selective ion trap or mass analyser 4. Ions are preferably released as packets of ions from the exit of the first ion guide 6 and the ions in each packet of ions released from the first ion guide 6 are preferably arranged to be mass analysed by an orthogonal acceleration Time of Flight mass analyser 13 which is preferably arranged downstream of the first ion guide 6.

According to an embodiment ions may be arranged such that they enter the second ion guide 14 with relatively low energies in which case they may not be caused to fragment. The energy of the ions entering the second ion guide 14 can be controlled, for example, by setting the level of a voltage difference experienced by the ions prior to entering the second ion guide 14. Since the voltage difference can be switched near instantaneously, the second ion guide 14 can, in effect, be considered to be switchable between a relatively high fragmentation mode of operation and a relatively low fragmentation mode of operation.

The voltage difference experienced by the ions prior to entering the second ion guide 14 may be switched according to another embodiment between a relatively low value and a relatively high value on successive scans of the mass selective ion trap or mass analyser 4.

In yet another mode of operation fragment or daughter ions which are ejected from the mass selective ion trap or mass analyser 4 may be arranged such that they are sufficiently energetic that when they enter the first ion guide 6 arranged downstream of the mass selective ion trap or mass analyser 4 then they are caused to collide with gas molecules present in the ion guide 6 and fragment into second generation fragment or daughter ions (or grand-daughter ions). Subsequent mass analysis of the grand-daughter ions may yield valuable mass spectral information about the associated daughter or fragment ions and the related parent or precursor ions.

Ions may also be arranged such that they enter the first ion guide 6 arranged downstream of the mass selective ion trap or mass analyser 4 at relatively low energies in which case they may not substantially fragment. The energy of ions entering the first ion guide 6 arranged downstream of the mass selective ion trap or mass analyser 4 can be controlled by, for example, setting the level of a voltage difference experienced by the ions prior to entering the first ion guide 6. Since the voltage difference can be switched near instantaneously, the first ion guide 6 can, in effect, be considered to be switchable between a relatively high fragmentation mode of operation and a relatively low fragmentation mode of operation.

The voltage difference experienced by the ions prior to entering the first ion guide 6 may also be varied during the course of a scan of the mass selective ion trap or mass analyser 4. This may be set such that the collision energy is optimised for one or more fragment or daughter ions as the fragment or daughter ions emerge from the mass selective ion trap or mass analyser 4.

Alternatively, the collision energy may be progressively varied during the course of a mass scan of the mass selective ion trap or mass analyser 4 such that the collision energy is approximately optimised for each fragment or daughter ion as it emerges from the mass selective ion trap or mass analyser 4.

The voltage difference experienced by fragment or daughter ions prior to entering the first ion guide 6 may also be switched according to another embodiment between a relatively low value and a relatively high value on successive scans of the mass selective ion trap or mass analyser 4.

The high value of voltage difference experienced by fragment or daughter ions prior to entering the first ion guide 6 may be progressively varied during the course of a scan of the mass selective ion trap or mass analyser 4 such that the collision energy is approximately optimised for each fragment or daughter ion as it emerges from the mass selective ion trap or mass analyser 4.

Although the present invention has been described with reference to preferred embodiments, it will be understood by those skilled in the art that various changes in form and detail may be made without departing from the scope of the invention as set forth in the accompanying claims.

The invention claimed is:

1. A mass spectrometer comprising:

a mass selective ion trap or mass analyser for separating ions exclusively according to mass or mass to charge ratio;

a first ion guide arranged downstream of said mass selective ion trap or mass analyser, said first ion guide being arranged to receive ions from said mass selective ion trap or mass analyser, and wherein said first ion guide comprises a plurality of electrodes;

a first voltage supply arranged and adapted to apply one or more voltages or one or more voltage waveforms to said plurality of electrodes so that in a first mode of operation ions received from said mass selective ion trap or mass analyser are retained or confined or transported or translated in separate regions or portions of said first ion guide;

a mass analyser arranged downstream of said first ion guide; and a control system arranged and adapted to switch or repeatedly switch, at least once every 10 seconds, the potential difference through which ions pass prior to entering said first ion guide between a high fragmentation mode of operation wherein ions are substantially fragmented upon entering said first ion guide and a low fragmentation mode of operation wherein substantially fewer ions are fragmented or wherein substantially no ions are fragmented upon entering said first ion guide.

2. A mass spectrometer as claimed in claim 1, wherein said mass selective ion trap or mass analyser is selected from the group consisting of: (i) a 3D quadrupole or Paul ion trap or mass analyser; (ii) a 2D or linear quadrupole ion trap or mass analyser; (iii) a cylindrical ion trap or mass analyser; (iv) a cubic ion trap or mass analyser; (v) an AC or RF voltage supply for confining ions radially within said mass selective ion trap or mass analyser and a DC voltage supply for confining ions axially within said mass selective ion trap or mass analyser; (vi) a Penning ion trap; and (vii) an electrostatic or orbitrap mass analyser.

3. A mass spectrometer as claimed in claim 1, further comprising an AC or RF voltage supply arranged and adapted to apply an AC or RF voltage to said mass selective ion trap or mass analyser, wherein said AC or RF voltage supply is arranged and adapted to supply an AC or RF voltage having an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

4. A mass spectrometer as claimed in claim 3, wherein said AC or RF voltage supply is arranged and adapted to supply an AC or RF voltage having a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

5. A mass spectrometer as claimed in claim 1, further arranged and adapted to maintain in a mode of operation said mass selective ion trap or mass analyser at a pressure selected from the group consisting of: (i) $<1.0\times10^{-1}$ mbar; (ii) $<1.0\times10^{-2}$ mbar; (iii) $<1.0\times10^{-3}$ mbar; (iv) $<1.0\times10^{-4}$ mbar; (v) $<1.0\times10^{-5}$ mbar; (vi) $<1.0\times10^{-6}$ mbar; (vii) $<1.0\times10^{-7}$ mbar; (viii) $<1.0\times10^{-8}$ mbar; (ix) $<1.0\times10^{-9}$ mbar; (x) $<1.0\times10^{-10}$ mbar; (xi) $>1.0\times10^{-3}$ mbar; (xii) $>1.0\times10^{-2}$ mbar; (xiii) $>1.0\times10^{-1}$ mbar; (xiv) >1 mbar; (xv) >10 mbar; (xvi) >100 mbar; (xvii) $>5.0\times10^{-3}$ mbar; (xviii) $>5.0\times10^{-2}$ mbar; (xix) $10^{-3}$–$10^{-2}$ mbar; and (xx) $10^{-4}$–$10^{-1}$ mbar.

6. A mass spectrometer as claimed in claim 1, wherein ions are trapped but are not substantially fragmented within said mass selective ion trap or mass analyser.

7. A mass spectrometer as claimed in claim 1, further comprising ejection means arranged and adapted either: (i) to resonantly or mass selectively eject ions from said mass selective ion trap or mass analyser; (ii) to non-resonantly or mass selectively eject ions from said mass selective ion trap or mass analyser; or (iii) to eject or emit ions axially or radially from said mass selective ion trap or mass analyser.

8. A mass spectrometer as claimed in claim 1, wherein said first ion guide is selected from the group consisting of:

(i) a segmented multipole rod set;

(ii) an ion tunnel or ion funnel; and (iii) a stack or array of planar, plate or mesh electrodes.

9. A mass spectrometer as claimed in claim 1, wherein said first ion guide comprises a plurality of axial segments or at least 5, 10, 15, 20, 25, 30, 35, 40, 45, 50, 55, 60, 65, 70, 75, 80, 85, 90, 95 or 100 axial segments.

10. A mass spectrometer as claimed in claim 1, further comprising a transient DC voltage supply arranged and adapted to apply one or more transient DC voltages or potentials or one or more transient DC voltage or potential waveforms to electrodes forming said first ion guide in order to urge at least some ions along at least 5%, 10%, 15%, 20%, 25%, 30%, 35%, 40%, 45%, 50%, 55%, 60%, 65%, 70%, 75%, 80%, 85%, 90%, 95% or 100% of the axial length of said first ion guide.

11. A mass spectrometer as claimed in claim 1, further comprising an AC or RF voltage supply arranged and adapted to apply two or more phase-shifted AC or RF voltages to electrodes forming said first ion guide in order to urge at least some ions along at least 5%, 10%, 15%, 20%, 25%, 30%, 35%, 40%, 45%, 50%, 55%, 60%, 65%, 70%, 75%, 80%, 85%, 90%, 95% or 100% of the axial length of said first ion guide.

12. A mass spectrometer as claimed in 1, further arranged and adapted to accelerate ions emerging from said mass selective ion trap or mass analyser into said first ion guide and wherein in a second mode of operation at least 5%, 10%, 15%, 20%, 25%, 30%, 35%, 40%, 45%, 50%, 55%, 60%, 65%, 70%, 75%, 80%, 85%, 90%, 95% or 100% of said ions are caused to fragment upon entering said first ion guide.

13. A mass spectrometer as claimed in claim 12, arranged and adapted to progressively vary or increase the kinetic energy of ions emerging from said mass selective ion trap or mass analyser as are transmitted to said first ion guide.

14. A mass spectrometer as claimed in claim 1, wherein in said high fragmentation mode of operation ions entering said first ion guide are accelerated through a potential difference selected from the group consisting of: (i) ≥10 V; (ii) ≥20 V; (iii) ≥30 V; (iv) ≥40 V; (v) ≥50 V; (vi) ≥60 V; (vii) ≥70 V; (viii) ≥80 V; (ix) ≥90 V; (x) ≥100 V; (xi) ≥110 V; (xii) ≥120 V; (xiii) ≥130 V; (xiv) ≥140 V; (xv) ≥150 V; (xvi) ≥160 V; (xvii) ≥170 V; (xviii) ≥180 V; (xix) ≥190 V; and (xx) ≥200 V.

15. A mass spectrometer as claimed in claim 1, wherein in said low fragmentation mode of operation ions entering said first ion guide are accelerated through a potential difference selected from the group consisting of: (i) ≤20 V; (ii) ≤15 V; (iii) ≤10 V; (iv) ≤5V; and (v) ≤1V.

16. A mass spectrometer as claimed in claim 1, wherein said control system is arranged and adapted to switch said first ion guide between said high fragmentation mode of operation and said low fragmentation mode of operation at least once every 1 ms, 5 ms, 10 ms, 15 ms, 20 ms, 25 ms, 30 ms, 35 ms, 40 ms, 45 ms, 50 ms, 55 ms, 60 ms, 65 ms, 70 ms, 75 ms, 80 ms, 85 ms, 90 ms, 95 ms, 100 ms, 200 ms, 300 ms, 400 ms, 500 ms, 600 ms, 700 ms, 800 ms, 900 ms, 1 s, 2 s, 3 s, 4 s, 5 s, 6 s, 7 s, 8 s, or 9 s.

17. A mass spectrometer as claimed in claim 1, wherein said first ion guide is arranged and adapted to retain or confine or partition ions emerging from said mass selective ion trap or mass analyser and to translate ions in one or more groups or packets of ions along at least 5%, 10%, 15%, 20%, 25%, 30%, 35%, 40%, 45%, 50%, 55%, 60%, 65%, 70%, 75%, 80%, 85%, 90%, 95% or 100% of the axial length of said first ion guide whilst either: (i) substantially maintaining the order or fidelity in which ions emerge from said mass selective ion trap or mass analyser; or (ii) substantially maintaining the composition of ions as one or more groups or packets of ions are translated along said first ion guide.

18. A mass spectrometer as claimed in claim 1, wherein said first ion guide is arranged and adapted to collisionally cool, substantially thermalise or substantially reduce the kinetic energy of ions within said first ion guide.

19. A mass spectrometer as claimed in claim 1, further comprising an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation On Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; and (xviii) a Thermospray ion source.

20. A mass spectrometer as claimed in claim 1, wherein said mass analyser is selected from the group consisting of: (i) a Time of Flight mass analyser; (ii) an axial or orthogonal acceleration Time of Flight mass analyser; (iii) a quadrupole mass analyser; (iv) a 2D or linear quadrupole mass analyser; (v) a Paul or 3D quadrupole mass analyser; (vi) a Penning trap mass analyser; (vii) an ion trap mass analyser; (viii) a magnetic sector mass analyser; (ix) Ion Cyclotron Resonance ("ICR") mass analyser; (x) a Fourier Transform Ion Cyclotron Resonance ("FTICR") mass analyser; (xi) an electrostatic or orbitrap mass analyser; (xii) a Fourier Transform electrostatic or orbitrap mass analyser; and (xiii) a Fourier Transform mass analyser.

21. A mass spectrometer comprising:

a mass selective ion trap or mass analyser for separating ions exclusively according to mass or mass to charge ratio;

a first ion guide arranged downstream of said mass selective ion trap or mass analyser, said first ion guide being arranged to receive ions from said mass selective ion trap or mass analyser, and wherein said first ion guide comprises a plurality of electrodes wherein said first ion guide is arranged and adapted to receive a beam of ions from said mass selective ion trap or mass analyser and to convert or partition said beam of ions such that at least 2, 3, 4, 5, 6, 7, 8, 9, 10, 11, 12, 13, 14, 15, 16, 17, 18, 19 or 20 separate groups or packets of ions are confined or isolated in said first ion guide at any particular time;

a first voltage supply arranged and adapted to apply one or more voltages or one or more voltage waveforms to said plurality of electrodes so that in a first mode of operation ions received from said mass selective ion trap or mass analyser are retained or confined or transported or translated in separate regions or portions of said first ion guide;

a mass analyser arranged downstream of said first ion guide; and a control system arranged and adapted to switch or repeatedly switch the potential difference through which ions pass prior to entering said first ion guide between a high fragmentation mode of operation wherein ions are substantially fragmented upon entering said first ion guide and a low fragmentation mode of operation wherein substantially fewer ions are fragmented or wherein substantially no ions are fragmented upon entering said first ion guide.

22. A mass spectrometer as claimed in claim 21, wherein the average mass to charge ratio of ions in each of said groups or packets of ions confined or isolated in said first ion guide progressively increases or decreases with time or progressively increases or decreases from the exit region of said first ion guide towards the entrance region of said first ion guide.

23. A mass spectrometer as claimed in claim 21, wherein said first voltage supply is arranged and adapted to create at least 2, 3, 4, 5, 6, 7, 8, 9, 10, 11, 12, 13, 14, 15, 16, 17, 18, 19 or 20 separate axial potential wells which are substantially simultaneously translated along at least 5%, 10%, 15%, 20%, 25%, 30%, 35%, 40%, 45%, 50%, 55%, 60%, 65%, 70%, 75%, 80%, 85%, 90%, 95% or 100% of the length of said first ion guide, and wherein each group or packet of ions is separately confined or isolated in a separate axial potential well formed in said first ion guide.

24. A method of mass spectrometry comprising:

selectively ejecting ions from a mass selective ion trap or mass analyser exclusively according to mass or mass to charge ratio;

receiving ions from said mass selective ion trap or mass analyser into a first ion guide arranged downstream of said mass selective ion trap or mass analyser, said first ion guide comprising a plurality of electrodes;

applying one or more voltages or one or more voltage waveforms to said electrodes of said first ion guide so that in a first mode of operation ions received from said mass selective ion trap or mass analyser are retained or confined or transported or translated in separate regions or portions of said first ion guide;

providing a mass analyser downstream of said first ion guide; and repeatedly switching at least once every 10 seconds the potential difference through which ions pass prior to entering said first ion guide between a high fragmentation mode of operation wherein ions are substantially fragmented upon entering said first ion guide and a low fragmentation mode of operation wherein substantially fewer ions are fragmented or wherein substantially no ions are fragmented upon entering said first ion guide.

25. A method of mass spectrometry according to claim 24, wherein switching or repeatedly switching the potential difference through which ions pass prior to entering said first ion guide between the high fragmentation mode of operation and the low fragmentation mode of operation occurs at least once every ten seconds.

26. A method of mass spectrometry according to claim 24, wherein applying one or more voltages or one or more voltage waveforms to said electrodes of said first ion guide in the first mode of operation, creates at least two separate axial potential wells, which are substantially simultaneously translated along at least 5% of the length of the ion guide and separately confines or isolates separate groups or packets of ions in the separate axial potential wells, formed in the first ion guide.

* * * * *